US010699634B2

(12) United States Patent
Hayashi et al.

(10) Patent No.: US 10,699,634 B2
(45) Date of Patent: Jun. 30, 2020

(54) DISPLAY DEVICE AND METHOD FOR DRIVING DISPLAY DEVICE

(71) Applicant: JOLED INC., Tokyo (JP)

(72) Inventors: Hiroshi Hayashi, Tokyo (JP); Shinya Ono, Osaka (JP)

(73) Assignee: JOLED INC., Tokyo (JP)

( * ) Notice: Subject to any disclaimer, the term of this patent is extended or adjusted under 35 U.S.C. 154(b) by 324 days.

(21) Appl. No.: 15/304,944

(22) PCT Filed: Dec. 22, 2014

(86) PCT No.: PCT/JP2014/006399
§ 371 (c)(1),
(2) Date: Oct. 18, 2016

(87) PCT Pub. No.: WO2015/162651
PCT Pub. Date: Oct. 29, 2015

(65) Prior Publication Data

US 2017/0186369 A1 Jun. 29, 2017

(30) Foreign Application Priority Data

Apr. 21, 2014 (JP) ..... 2014-087636

(51) Int. Cl.
*G09G 3/3233* (2016.01)

(52) U.S. Cl.
CPC ... *G09G 3/3233* (2013.01); *G09G 2300/0842* (2013.01); *G09G 2310/0254* (2013.01);
(Continued)

(58) Field of Classification Search
CPC ..... G09G 3/3233
See application file for complete search history.

(56) References Cited

U.S. PATENT DOCUMENTS 9,093,028 B2 7/2015 Chaji
9,224,331 B2 12/2015 Kretz et al.
(Continued)

FOREIGN PATENT DOCUMENTS

JP 2009-217154 9/2009
JP 2011-123508 6/2011
(Continued)

OTHER PUBLICATIONS

International Search Report (ISR) in International Pat. Appl. No. PCT/JP2014/006399, dated Mar. 31, 2015.

*Primary Examiner* — Amr A Awad
*Assistant Examiner* — Maheen I Javed
(74) *Attorney, Agent, or Firm* — Greenblum & Bernstein, P.L.C.

(57) ABSTRACT

A display device includes: a display unit in which light-emitting pixels are disposed in rows and columns; and a control circuit controlling the display unit. The light-emitting pixels each include: a light-emitting element (organic EL element); and a drive transistor which supplies the light-emitting element with a current causing the light-emitting element to emit light, and the control circuit, when display by the display unit is stopped, calculates an amount of shift of a threshold voltage of the drive transistor at a time when a stopped state of the display unit is started, and determines on the basis of the amount of shift, at least one of (i) a recovery voltage which reduces the amount of shift by being applied across a gate and source of the drive transistor while the display by the display unit is stopped, and (ii) an application period during which the recovery voltage is applied.

12 Claims, 16 Drawing Sheets

(52) U.S. Cl.
CPC ..... *G09G 2320/029* (2013.01); *G09G 2320/0233* (2013.01); *G09G 2320/043* (2013.01); *G09G 2320/048* (2013.01); *G09G 2330/02* (2013.01); *G09G 2354/00* (2013.01)

(56) References Cited

U.S. PATENT DOCUMENTS

| | | | | |
|---|---|---|---|---|
| 9,262,965 | B2 | 2/2016 | Chaji et al. | |
| 2008/0007547 | A1 | 1/2008 | Hasumi et al. | |
| 2009/0096725 | A1 | 4/2009 | Kretz et al. | |
| 2011/0134157 | A1 | 6/2011 | Chaji | |
| 2012/0113086 | A1 | 5/2012 | Koyama | |
| 2012/0206340 | A1* | 8/2012 | Mori | G09G 5/00 345/156 |
| 2013/0002637 | A1 | 1/2013 | Hasumi et al. | |
| 2013/0100173 | A1* | 4/2013 | Chaji | G09G 5/10 345/690 |
| 2014/0043316 | A1 | 2/2014 | Chaji et al. | |
| 2015/0161968 | A1 | 6/2015 | Hayashi et al. | |
| 2016/0267845 | A1* | 9/2016 | Tsuge | G09G 3/3233 |

FOREIGN PATENT DOCUMENTS

| | | |
|---|---|---|
| JP | 2012-113292 | 6/2012 |
| JP | 2013-047799 | 3/2013 |
| JP | 2013-513132 | 4/2013 |
| WO | 2006/070833 | 7/2006 |

* cited by examiner

FIG. 25

| No. | Location of measurement sample for obtaining $\Delta V_{th}$ data | | Shape of sample | | Method of generating $\Delta V_{th}$ map | | Method of applying $V_{gs}$ to drive transistor of each of light-emitting pixels | | | |
|---|---|---|---|---|---|---|---|---|---|---|
| | | | | | | | Voltage based on display | | Recovery voltage | |
| | | | Light-emitting pixel | TFT single body | Availability of generating data for all light-emitting pixels within display region | Availability of generating data for each region when display region is divided into one or more regions (A) | $V_{gs}$ based on display | Representative $V_{gs}$ of each of regions (A) | Adjusted for each light-emitting pixel | Apply identical recovery voltage to all light-emitting pixels in region (A) |
| 1 | Each of light-emitting pixels | | ○ | ○ | ○ | ○ | ○ | ○ | ○ | ○ |
| 2 | Representative location | Within display region | ○ | ○ | ○ (Estimated value) | ○ (Estimated value) | ○ | ○ (Regard $V_{gs}$ applied to sample as $V_{gs}$ of each of regions (A)) | ○ (Recovery voltage based on estimated value) | ○ (Recovery voltage based on estimated value) |
| 3 | | Outside display region | ○ | ○ | ○ (Estimated value) | ○ (Estimated value) | × (No display data for measurement sample) | ○ (Regard $V_{gs}$ applied to sample as $V_{gs}$ of each of regions (A)) | ○ (Recovery voltage based on estimated value) | ○ (Recovery voltage based on estimated value) |

DISPLAY DEVICE AND METHOD FOR DRIVING DISPLAY DEVICE

TECHNICAL FIELD

The present disclosure relates to display devices and methods for driving the display devices, and particularly relates to a method for driving a display device using a current-driven light-emitting element.

BACKGROUND ART

In recent years, organic EL (electroluminescent) displays which make use of organic EL (electroluminescence) have been the focus of attention as one of next-generation flat panel displays to replace liquid-crystal displays. In active-matrix display devices such as organic EL displays, thin-film transistors (TFTs) are used as drive transistors.

CITATION LIST

Patent Literature

[PTL 1] International Publication No. 2006/070833

SUMMARY OF INVENTION

Technical Problem

In a TFT, a threshold voltage of the TFT shifts due to voltage stress such as a gate-source voltage when the TFT is powered up. The shift of the threshold voltage with the passage of time may cause variation in the amount of current supplied to the organic EL, and thus affects luminance control of the display device, leading to deterioration of the display quality.

Patent Literature (PTL) 1 discloses, as a method of suppressing the effect of luminance change in the organic EL due to the threshold voltage shift, a method of reducing the amount of threshold voltage shift by applying a voltage (reverse bias) less than or equal to a threshold voltage across the gate and source. However, with the method described in PTL1, there are instances where the effect of the threshold voltage shift cannot be sufficiently suppressed.

In view of the above, the present disclosure provides a display device and a method for driving the display device, which are capable of recovering a threshold voltage of a drive transistor.

Solution to Problem

In order to solve the above-described problem, the display device according to an aspect of the present disclosure is a display device including a display unit in which a plurality of light-emitting pixels are disposed in rows and columns; and a control circuit which controls the display unit, wherein each of the plurality of light-emitting pixels includes: a light-emitting element; and a drive transistor which supplies the light-emitting element with a current that causes the light-emitting element to emit light, and the control circuit, when display by the display unit is stopped, calculates an amount of shift of a threshold voltage of the drive transistor at a time when a stopped state of the display unit is started, and determines on a basis of the amount of shift, at least one of (i) a recovery voltage which reduces the amount of shift by being applied across a gate and source of the drive transistor while the display by the display unit is stopped, and (ii) an application period during which the recovery voltage is applied.

Advantageous Effects of Invention

With the display device and the method of driving the same according to the present disclosure, it is possible to recover the threshold voltage of the drive transistor.

BRIEF DESCRIPTION OF DRAWINGS

FIG. 25 is a table illustrating locations and characteristics of each of the locations of measurement samples used for reading the amount of threshold voltage shift.

DESCRIPTION OF EMBODIMENTS (Underlying Knowledge Forming the Basis of the Present Disclosure)

Underlying knowledge forming the basis of the present disclosure is described below prior to describing details of the present disclosure.

Figure 1:
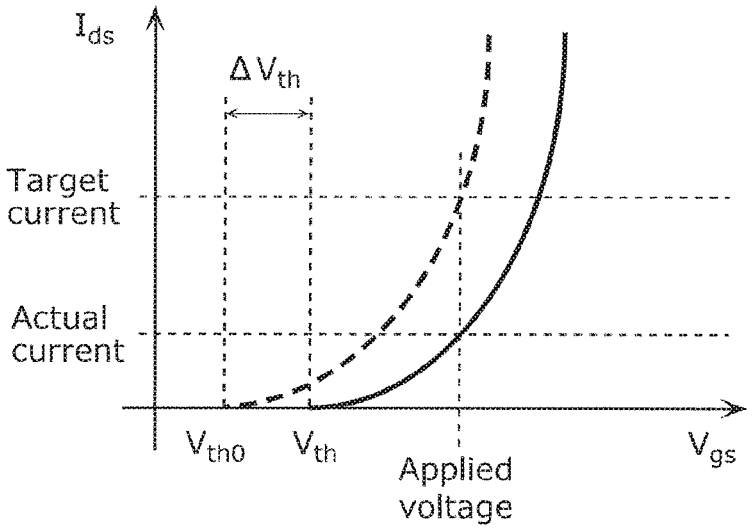
PRIOR ART FIG. 1
FIG. 1 is a graph illustrating an outline of transmission characteristics of a TFT.
Figure 2:
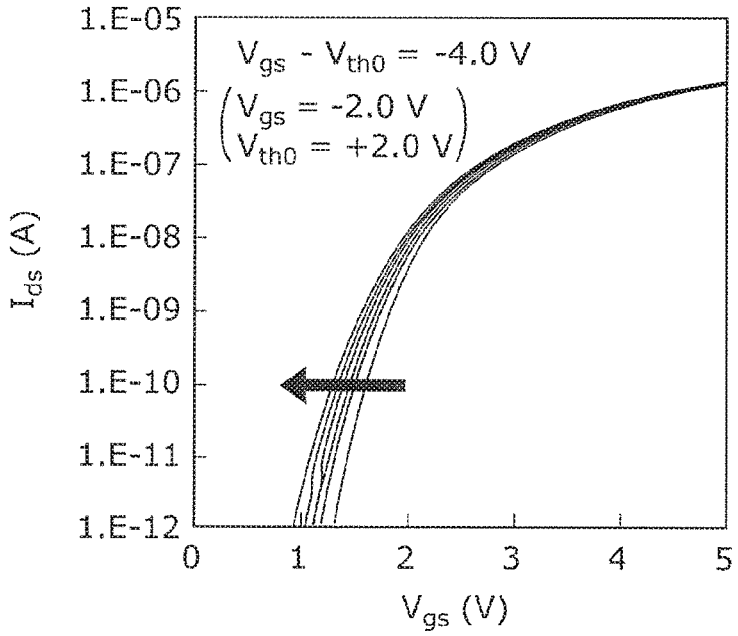
FIG. 2 is a graph illustrating the change over time of transmission characteristics of a TFT when stress is applied.
Figure 3:
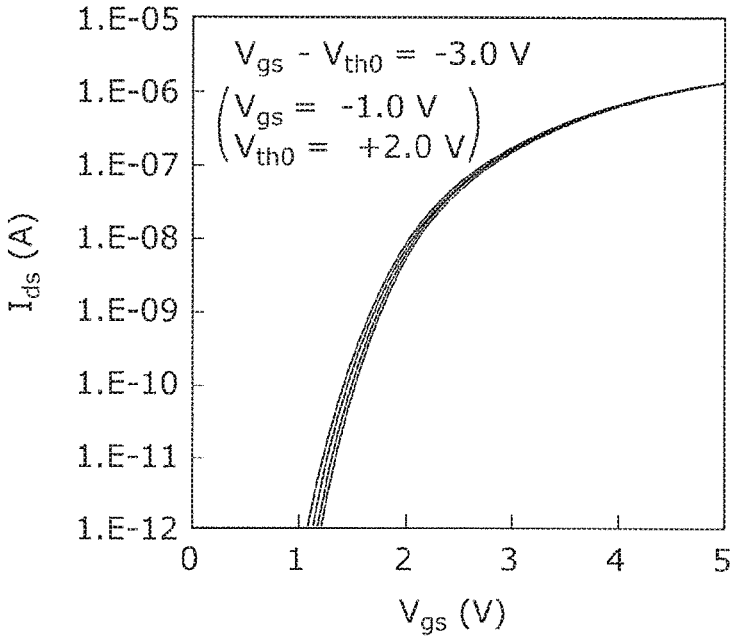
FIG. 3 is a graph illustrating the change over time of transmission characteristics of a TFT when stress is applied.
Figure 4:
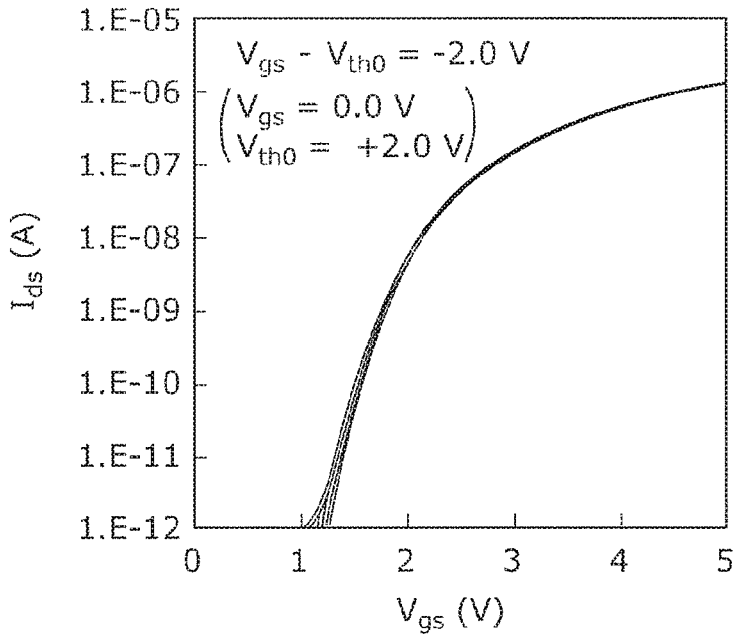
FIG. 4 is a graph illustrating the change over time of transmission characteristics of a TFT when stress is applied.
Figure 5:
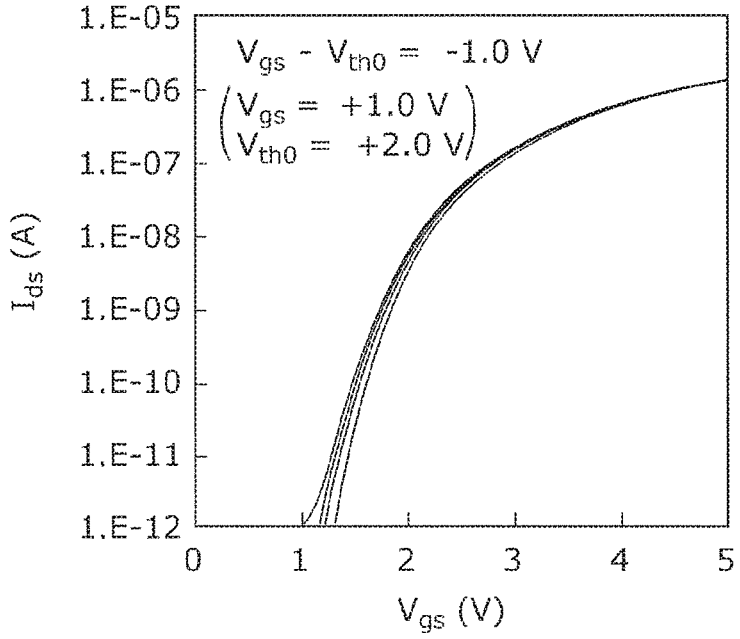
FIG. 5 is a graph illustrating the change over time of transmission characteristics of a TFT when stress is applied.
Figure 6:
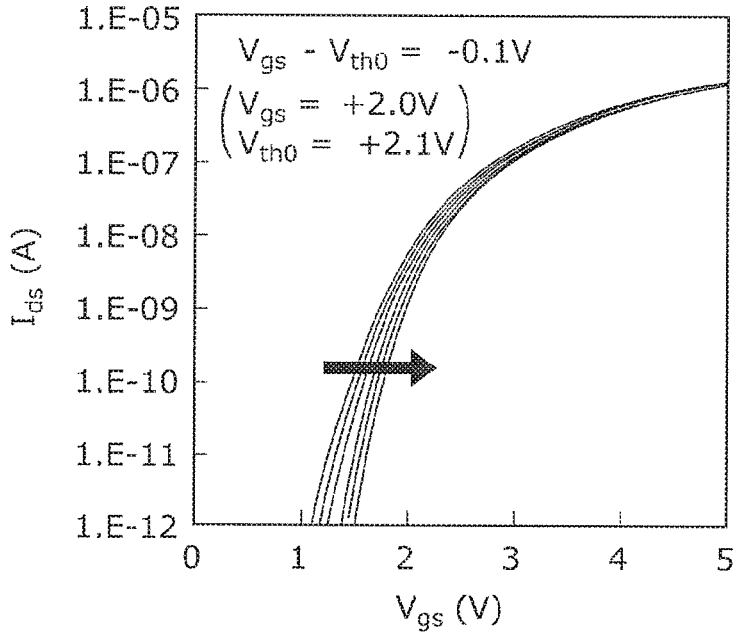
FIG. 6 is a graph illustrating the change over time of transmission characteristics of a TFT when stress is applied.

The threshold voltage of a drive transistor included in a light-emitting pixel of the organic EL display device will be described. In the drive transistor configured of a TFT, the threshold voltage changes over time when voltage is applied. Specifically, when a bias is applied to the gate electrode of the drive transistor, electrons are injected to a gate insulating film when a positive bias is applied, and holes are injected when a negative bias is applied, and thus a positive or negative threshold voltage shift occurs. FIG. 1 is a graph illustrating an outline of the relationship (transmission characteristics) between a gate-source voltage $V_{gs}$ (video signal voltage) that is applied across the gate and source of the drive transistor and a current $I_{ds}$ (current supplied to the organic EL element) which flows across the drain and source. In FIG. 1, the broken line denotes the transmission characteristics of the drive transistor at the start of usage, and the solid line denotes the transmission characteristics after the threshold voltage changes due to voltage application. As illustrated in FIG. 1, in a TFT, the threshold voltage shifts from $V_{th0}$ to $V_{th}$ depending on the magnitude of a voltage applied across the gate and source and the application period. Accordingly, at the start of usage, even when an applied voltage needed to obtain a target current is applied after the threshold voltage shift, the target current is not obtained, and current of the desired magnitude cannot be supplied to the organic EL element. In view of this, a technique of driving a TFT is known, in which the gate-source voltage $V_{gs}$ is offset according to the threshold voltage $V_{th}$ in order to suppress the effect of the change in luminance of the organic EL element due to the threshold voltage shift, in the organic EL display device. However, there is a limitation on an amount of offsetting the gate-source voltage $V_{gs}$ due to a limit on voltage generation of the drive circuit or the like, and thus it is not possible to suppress the effect of the change in luminance of the organic EL element when a threshold voltage shift exceeding the limitation occurs.

In view of the above, the display device described in PTL 1 uses a technique of applying reverse bias across the gate-source of the drive transistor. The reverse bias, here, means that the gate-source voltage $V_{gs}$ is less than the threshold voltage $V_{th}$ in the case of an n-type drive transistor. The reverse bias, here, also means that the gate-source voltage $V_{gs}$ is greater than the threshold voltage $V_{th}$ in the case of a p-type drive transistor. PTL 1 discloses a display device which is capable of recovering a threshold voltage by applying reverse bias across the gate and source of the drive transistor.

However, PTL 1 does not describe the relationship between (i) the magnitude of a reverse bias voltage and the application period of the reverse bias and (ii) the amount of recovery of a threshold voltage. Accordingly, with the display device described in PTL 1, there is a possibility that the threshold voltage cannot sufficiently be recovered and a possibility that reverse bias that is greater than necessary is applied.

The following describes a display device according to the present disclosure and a method for driving the display device, which can decrease the possibility of the problems described above.

(Outline of the Present Disclosure)

The display device according to an aspect of the present disclosure is a display device including a display unit in which a plurality of light-emitting pixels are disposed in rows and columns; and a control circuit which controls the display unit, wherein each of the plurality of light-emitting pixels includes: a light-emitting element; and a drive transistor which supplies the light-emitting element with a current that causes the light-emitting element to emit light, and the control circuit, when display by the display unit is stopped, calculates an amount of shift of a threshold voltage of the drive transistor at a time when a stopped state of the display unit is started, and determines on a basis of the amount of shift, at least one of (i) a recovery voltage which reduces the amount of shift by being applied across a gate and source of the drive transistor while the display by the display unit is stopped, and (ii) an application period during which the recovery voltage is applied.

In addition, in the display device according to an aspect of the present disclosure, the control circuit may calculate the amount of shift on a basis of history of a voltage applied across the gate and source of the drive transistor.

In addition, in the display device according to an aspect of the present disclosure, the control circuit may measure the amount of shift.

In addition, in the display device according to an aspect of the present disclosure, the control circuit may change the recovery voltage while the display by the display unit is stopped.

In addition, in the display device according to an aspect of the present disclosure, the control circuit, when the display by the display unit is stopped, may estimate a stop period during which the display is maintained in the stopped state, and determine the application period on a basis of the estimated stop period.

In addition, in the display device according to an aspect of the present disclosure, the control circuit may determine the recovery voltage on a basis of the application period and the amount of shift.

In addition, in the display device according to an aspect of the present disclosure, the control circuit may apply a predetermined voltage across the gate and source of the drive transistor to suppress variation in the threshold voltage after the application period elapses.

In addition, in the display device according to an aspect of the present disclosure, the control circuit may calculate the recovery voltage for each of the plurality of light-emitting pixels, and apply the recovery voltage to a corresponding one of the plurality of light-emitting pixels.

In addition, the display device according to an aspect of the present disclosure may further include a monitoring unit configured to detect a person in proximity to the display unit, wherein the application period may be changed when the monitoring unit detects a person.

In addition, the method for driving a display device according to an aspect of the present disclosure is a method for driving a display device including a display unit in which a plurality of light-emitting pixels are disposed in rows and columns, each of the plurality of light-emitting pixels including a light-emitting element, and a drive transistor which supplies the light-emitting element with a current that causes the light-emitting element to emit light, the method for driving the display device including: when display by the display unit is stopped, calculating an amount of shift of a threshold voltage of the drive transistor at a time when a stopped state of the display unit is started; and determining on a basis of the amount of shift, at least one of (i) a recovery voltage which reduces the amount of shift by being applied across a gate and source of the drive transistor while the display by the display unit is stopped, and (ii) an application period during which the recovery voltage is applied.

(Relationship Between Threshold Voltage Shift and a Gate-Source Voltage)

First, prior to a description of the embodiments, a relationship between threshold voltage shift of a drive transistor and a gate-source voltage will be described. It should be noted that, in the following description, a threshold voltage is described assuming as a threshold voltage in a saturation region. Specifically, the threshold voltage is determined as below.

[Definition of a Threshold Voltage in a Saturation Region ($V_{gs}-V_{th}<V_{ds}$)]

The threshold voltage $V_{th}$ in the saturation region ($V_{gs}-V_{th}<V_{ds}$) can be defined as a value of the gate-source voltage $V_{gs}$ corresponding to an intersection between a characteristic tangent line $(I_{ds})^{1/2}-V_{gs}$ at a point $V_{gs}$ at which mobility is the maximum value and a $V_{gs}$ voltage axis (x axis), which represents characteristics between the square root of the drain-source current ($(I_{ds})^{1/2}$) and the gate-source voltage ($V_{gs}$). Here, the mobility is obtained by assigning a gradient $d(I_{ds})^{1/2}/d\,V_{gs}$ of the characteristics between $(I_{ds})^{1/2}$ and $V_{gs}$ to Expression 1. It should be noted that L denotes a channel length, W denotes a channel width, and C denotes a gate capacitance per a unit area.

[Math. 1]

$$\mu = \frac{2L}{WC}\left(\frac{d\sqrt{I_{ds}}}{dV_{gs}}\right)^2 \quad \text{Expression 1}$$

First, a TFT to which stress is not applied is prepared, a drain potential $V_d$ and a source potential $V_s$ are set to 0 V, and stress is applied for three hours while a gate potential $V_g$ is maintained to a predetermined value. The experiment used a TFT including a gate insulating film configured of a 220-nm-thick silicon nitride film and a 50-nm-thick silicon oxide film, and a semiconductor layer configured of a 90-nm-thick oxide semiconductor. As the gate potential $V_g$, −5.0 V, −4.0 V, −3.0 V, . . . , +3.0 V, +4.0 V, and +5.0 V were selected, and the environmental temperature was maintained at 90 degrees Celsius. It should be noted that, when a temperature acceleration coefficient which is calculated using approximately 400 meV of thermal activation energy of the threshold voltage shift is converted into a stress period, voltage stress for three hours in the environmental temperature of 90 degrees Celsius that is an experimental condition corresponds to voltage stress for several tens of hours.

The result of the experiment shall be described with reference to FIG. 2 to FIG. 7.

FIG. 2 to FIG. 6 are graphs each illustrating the change over time of the transmission characteristics in the case where a difference between the gate-source voltage $V_{gs}$ and the initial value $V_{th0}$ of the threshold voltage is respectively set to −4.0 V, −3.0 V, −2.0 V, −1.0 V, 0 V, and 0.1 V.

As illustrated in FIG. 2 to FIG. 6, the threshold voltage shift is the smallest in the case of $V_{gs}-V_{th0}=-2.0$ V. In addition, the negative shift increases as the value of $V_{gs}-V_{th0}$ decreases from −2.0 V, and the positive shift increases as the value of $V_{gs}$ $V_{th0}$ increases from −2.0 V.

Figure 7:
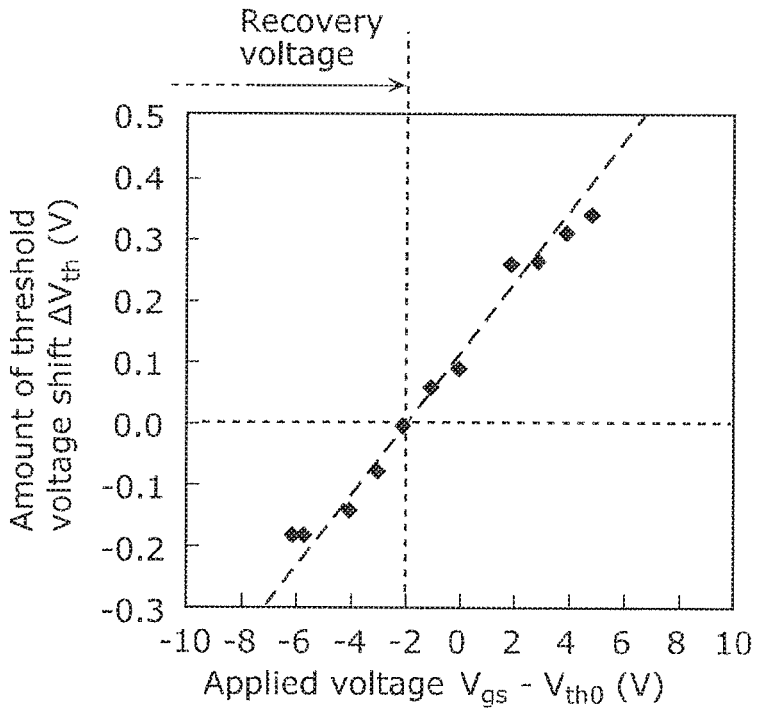
FIG. 7 is a graph illustrating a relationship between an applied voltage to a TFT and a threshold voltage shift.

FIG. 7 is a graph illustrating applied voltage ($V_{gs}$ $V_{th0}$) dependency of the amount of threshold voltage shift $\Delta V_{th}$, by combining the results of the experiment.

As illustrated in FIG. 7, the threshold voltage shifts to the negative direction by reducing the value of $V_{gs}-V_{th0}$ to be smaller than −2.0V. More specifically, when the threshold voltage shifts to the positive direction due to positive bias, it is possible to recover the threshold voltage by applying $V_{gs}$ such that the value of $V_{gs}$ $V_{th0}$ is smaller than −2.0 V. Furthermore, as illustrated in FIG. 7, the amount of recovery of the threshold voltage changes according to the value of $V_{gs}-V_{th0}$. The amount of recovery of the threshold voltage is determined by $V_{gs}$ and the application period of $V_{gs}$, and can also be calculated by modelization. Details of the modelization shall be described later.

It should be noted that, in the following description, the gate-source voltage which reduces the amount of shifting of the threshold voltage to the positive direction (which recovers the threshold voltage) is referred to as a "recovery voltage", and the gate-source voltage which suppresses variation in the threshold voltage (with less threshold voltage shift) is referred to as a "balance voltage".

Hereinafter, embodiments shall be discussed in detail with reference to the drawings as necessary. However, description that is too detailed will be omitted in some cases. For example, there are instances where detailed description of well-known matter and redundant description of substantially identical components are omitted. This is for the purpose of preventing the following description from being unnecessarily redundant and facilitating understanding of those skilled in the art.

It should be noted that the accompanying drawings and subsequent description are provided by the inventors to allow a person of ordinary skill in the art to sufficiently understand the present disclosure, and are thus not intended to limit the scope of the subject matter recited in the Claims.

Embodiment 1

Hereinafter, the display device according to Embodiment 1 shall be described with reference to the Drawings.

[1-1. Configuration]

First, the configuration of the display device according to the embodiment shall be described.

Figure 8:
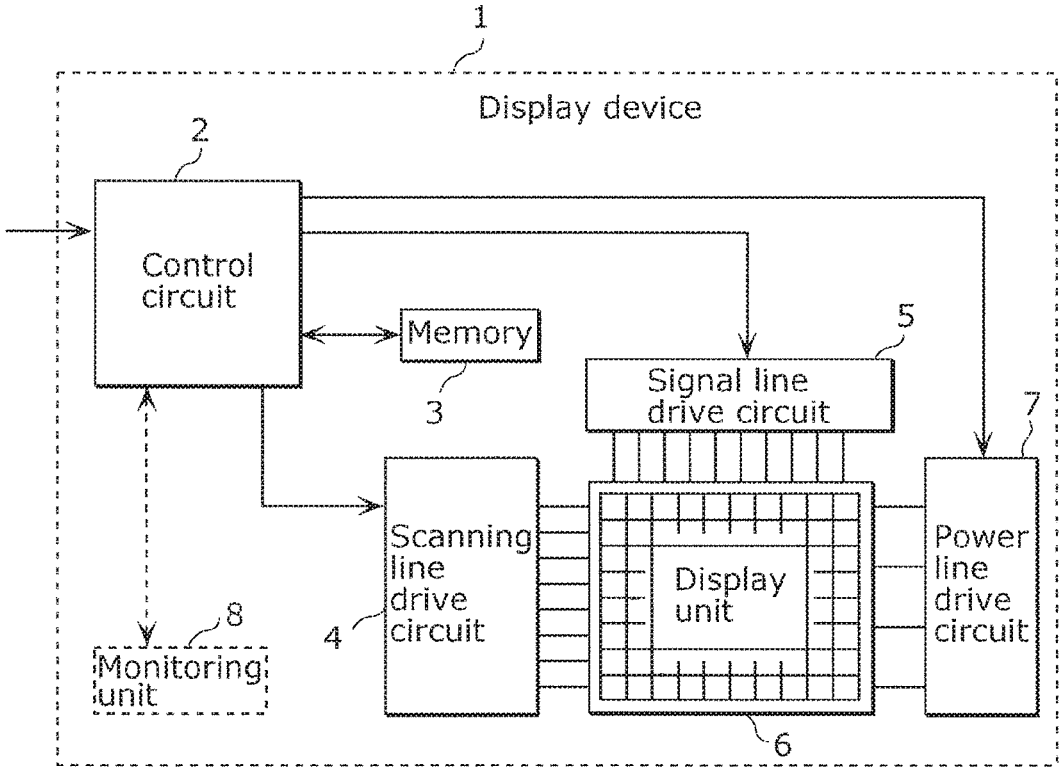
FIG. 8 is a block diagram illustrating an electrical configuration of a display device according to Embodiment 1.

FIG. 8 is a block diagram illustrating an electrical configuration of a display device according to the present embodiment. A display device 1 in the diagram includes a control circuit 2, a memory 3, a scanning line drive circuit 4, a signal line drive circuit 5, a display unit 6, a power line drive circuit 7, and a monitoring unit 8.

Figure 9:
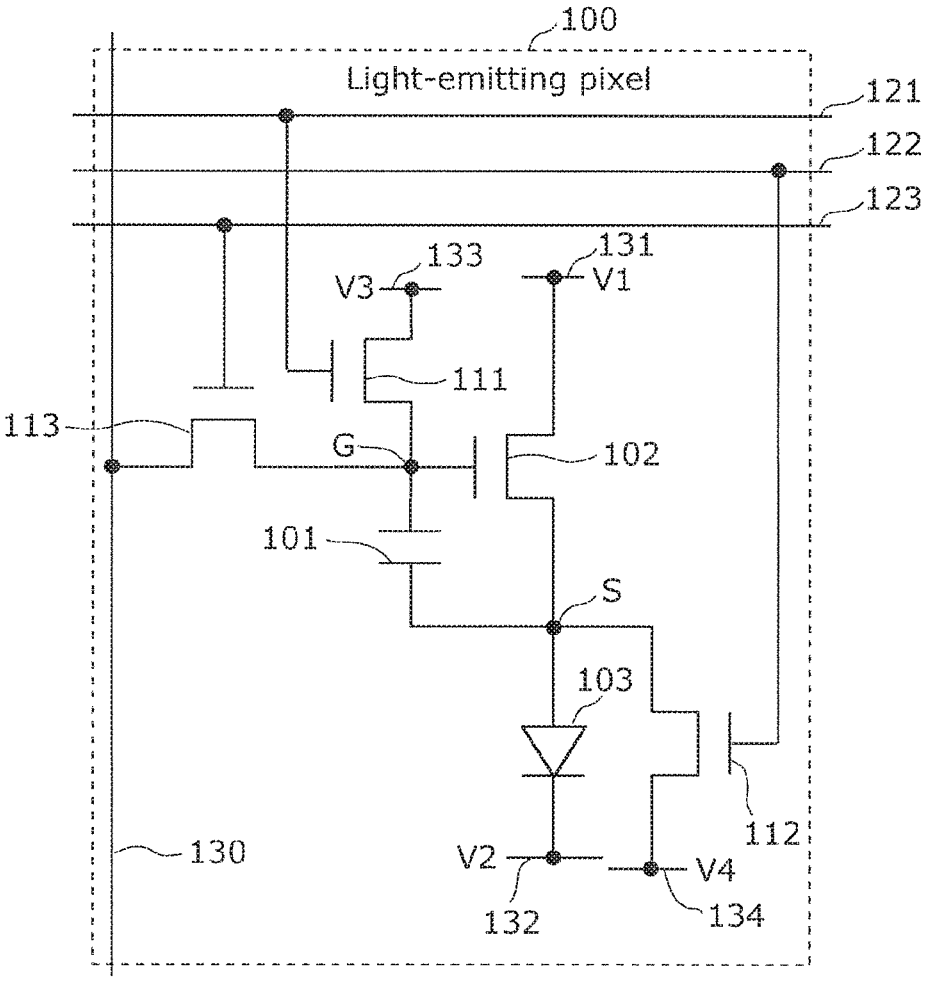
FIG. 9 is a circuit diagram illustrating a configuration of a light-emitting pixel included in the display device according to Embodiment 1.

FIG. 9 is a diagram illustrating a circuit configuration of a light-emitting pixel included in the display unit 6 of the display device 1 according to the present embodiment. As illustrated in FIG. 9, the light-emitting pixel 100 includes: an organic EL element 103; a drive transistor 102; a first switching transistor 111; a second switching transistor 112; a third switching transistor 113; a first capacitor 101; a first scanning line 121; a second scanning line 122; a third scanning line 123; a signal line 130; a first power line 131; a second power line 132; a third power line 133; and a fourth power line 134.

The first scanning line 121, the second scanning line 122, and the third scanning line 123 are scanning lines each of which transmits, to the light-emitting pixel 100, a scanning signal transmitted from the scanning line drive circuit 4.

The control circuit 2 is a circuit which controls the scanning line drive circuit 4, the signal drive circuit 5, the display unit 6, the power line drive circuit 7, the memory 3, and the monitoring unit 8. The control circuit 2 outputs, to the signal line drive circuit 5, a video signal inputted from the outside. In addition, data items such as cumulative stress of each of the drive transistors 102 and usage history of the display device 1 are recorded on the memory 3, and the control circuit 2 obtains, for example, the amount of threshold voltage shift of each of the drive transistors 102 on the basis of the data items. Details of the operation of the control circuit 2 shall be described later.

The scanning line drive circuit 4 is a drive circuit which is connected to the first scanning line 121, the second scanning line 122, and the third scanning line 123, and has a function of controlling conduction and non-conduction of the first switching transistor 111, the second switching transistor 112, and the third switching transistor 113 which are included in the light-emitting pixel 100, by outputting a scanning signal to the first scanning line, the second scanning line 122, and the third scanning line 123.

The signal line drive circuit 5 is a drive circuit which is connected to the signal line 130, and has a function of outputting a signal voltage based on the video signal to the light-emitting pixel 100.

The display unit 6 is a panel in which a plurality of light-emitting pixels 100 are arranged in a in a matrix, and displays an image on the basis of the video signal inputted to the display device 1 from the outside.

The power line drive circuit 7 is a drive circuit which is connected to the first power line 131, the second power line 132, the third power line 133, and the fourth power line 134, and has a function of applying a voltage to the elements in the light-emitting pixel 100 via each of the power lines.

The monitoring unit 8 is a detecting unit for detecting a person who is present in proximity to the display unit 6, and includes a human sensor, for example. The monitoring unit 8 outputs a signal to the control circuit 2 when the monitoring unit detects a person in proximity to the display unit 6. The control circuit 2 estimates duration during which the display unit 6 is maintained in the stopped state, using the signal inputted from the monitoring unit 8. It should be noted that, although the display device 1 according to the present embodiment includes the monitoring unit 8, the monitoring unit 8 need not be included in the display device 1.

The drive transistor 102 is a drive element which causes the organic EL element 103 to emit light by supplying a current to the organic EL element 103. The gate electrode of the drive transistor 102 is connected to one of the electrodes of the first capacitor 101. The source electrode of the drive transistor 102 is connected to the other of the electrodes of the first capacitor 101 and the anode electrode of the organic EL element 103. Furthermore, the drain electrode of the drive transistor 102 is connected to the first power lien 131. The drive transistor 102 connected as described above converts a voltage corresponding to a signal voltage applied across the gate and source into a drain current corresponding to the signal voltage. Subsequently, the drive transistor 102 supplies this drain current, as a single current, to the organic EL element 103. The drive transistor 102 is configured of, for example, an n-type TFT.

The first switching transistor 111 is a switching element whose gate electrode is connected to the first scanning line 121, one of the source electrode and the drain electrode is connected to the gate electrode of the drive transistor 102, and the other one of the source electrode and the drain electrode is connected to the third power line 133.

The second switching transistor 112 is a switching element whose gate electrode is connected to the second scanning line 122, one of the source electrode and the drain electrode is connected to the source electrode of the drive transistor 102, and the other one of the source electrode and the drain electrode is connected to the fourth power line 134.

The third switching transistor 113 is a switching element whose gate electrode is connected to the third scanning line 123, one of the source electrode and the drain electrode is connected to the gate electrode of the drive transistor 102, and the other one of the source electrode and the drain electrode is connected to the signal line 130.

The first capacitor 101 is a capacitive element having one electrode connected to the gate electrode of the drive transistor 102, and the other electrode connected to the source electrode of the drive transistor 102. The first capacitor 101 retains an electric charge corresponding to the signal voltage supplied from the signal line 130, and has a function of, for example, controlling, according to the video signal, the signal current which is transmitted from the drive transistor 102 to the organic EL element 103 after the second switching transistor 112 and the third switching transistor 113 are placed in a non-conductive state.

The organic EL element 103 is a light-emitting element whose cathode electrode is connected to the second power line 132, and anode electrode is connected to the source electrode of the drive transistor 102, and emits light according to the signal current controlled by the drive transistor 102.

The signal line 130 is connected to the signal line drive circuit 5 and to each of the light-emitting pixels which belong to the pixel column including the light-emitting pixel 100, and has a function of supplying a signal voltage corresponding to the video signal to each of the pixels. Furthermore, the display device 1 includes as many of the signal lines 130 as the number of pixel columns.

The first scanning line 121, the second scanning line 122, and the third scanning line 123 are connected to the scanning line drive circuit 4, and to each of the light-emitting pixels which belong to the pixel row including the light-emitting pixel 100. With this, the third scanning line 123 has a function of supplying the timing for writing the signal voltage into each of the light-emitting pixels that belong to the pixel row including the light-emitting pixel 100. In addition, the first scanning line 121 has a function of supplying the timing for detecting a threshold voltage of the drive transistor 102, by applying a voltage V3 of the third power line to the gate electrode of the drive transistor 102 included in the light-emitting pixel 100. Furthermore, the second scanning line 122 has a function of initializing the first capacitor 101 and the organic EL element 103 of the light-emitting pixel 100 in order to detect a threshold voltage of the drive transistor 102 of the light-emitting pixel 100.

The first power line 131 is a power line for applying a voltage V1 to the drain electrode of the drive transistor 102.

The second power line 132 is a power line for applying a voltage V2 to the cathode electrode of the organic EL element 103.

The third power line 133 is a power line for applying a voltage V3 (reference voltage) to the source electrode or the drain electrode of the first switching transistor 111, and is a power line which applies a voltage for preventing the organic EL element 103 from emitting light. In other words, V3 is set such that $V3-V2 \leq V_{th}+V_{th_EL}$ is satisfied. Here, $V_{th_EL}$ is a light emission starting voltage for the organic EL element 103.

The fourth power line 134 is a power line for initializing, to V4, the source voltage of the drive transistor 102 to which the first capacitor 101 and the organic EL element 103 are connected. It is desirable here that V4 is a voltage not causing the organic EL element 103 to emit light, and set such that $V4-V2 \leq V_{th_EL}$ is satisfied.

[1-2. Light Emitting Operation]

Next, a light emitting operation of the light-emitting pixel 100 shall be described.

First, the first switching transistor 111 is placed in a conductive state by a scanning signal supplied from the first scanning line 121, and the drive transistor 102 is placed in an off state to prevent a current from flowing across the source and drain of the drive transistor 102, by applying, to the gate electrode of the drive transistor 102, a predetermined voltage V3 supplied from the third power line.

Next, the second switching transistor 112 is placed in a conductive state by a scanning signal supplied from the second scanning line 122 while the conductive state of the first switching transistor 111 is maintained. With this, the gate-source voltage of the drive transistor 102 is set to V3 and V4, thereby making it possible to shift to the operation of detecting the threshold voltage ($V_{th_TFT}$) of the drive transistor 102.

Here, V3 is set such that $V3-V4 \geq V_{th_TFT}$ is satisfied. With this, together with the above-described conditions of $V3-V2 \leq V_{th_EL}+V_{th_TFT}$ and $V2-V4 \leq V_{th_EL}$, it is possible to reliably place the organic EL element 103 in a non-fight-emitting state even when the detecting period of the threshold voltage of the drive transistor 102 ends, while the organic EL element 103 is placed in a reverse bias state to function as an electrostatic capacitance. In other words, it is possible to stably perform the detection operation of the threshold voltage.

Next, the second switching transistor 112 is placed in a non-conductive state by a scanning signal supplied from the second scanning line 122 while the conductive state of the first switching transistor 111 is maintained. Since the gate-source voltage of the drive transistor 102 is $V3-V4 \geq V_{th_TFT}$ At this point, the drive transistor 102 is in a conductive state, and the drain-source current of the drive transistor 102 flows to the organic EL element 103 which is in the reverse bias state and the first capacitor 101. With this, the organic EL element 103 and the first capacitor 101 are charged, a potential of the source electrode of the drive transistor 102 increases, and eventually the gate-source voltage of the drive transistor 102 is set to $V_{th_TFT}$, in other words, a potential of the source electrode of the drive transistor 102 is set to $V3-V_{th_TFT}$. Then the drive transistor 102 is placed in an off state, and charging of the organic EL element 103 and the first capacitor 101 by the drain-source current of the drive transistor 102 stops. Thus, the threshold voltage of the drive transistor 102 is retained by the organic EL element 103 and the first capacitor 101.

Next, the first switching transistor 111 is placed in a non-conductive state by a scanning signal supplied from the first scanning line 121.

Next, the third switching transistor 113 is placed in a conductive state by a scanning signal supplied from the third scanning line 123, and a signal voltage ($V_{data}$) supplied from the signal line 130 is applied to the gate electrode of the drive transistor 102. At this time, the potential of the gate electrode of the drive transistor 102 changes from V3 to $V_{data}$. More specifically, the first capacitor 101 retains $(V_{data}-V3)\times(C_{el}/(C_{el}+C_s))+V_{th_TFT}$, and this voltage is set to the gate-source voltage of the drive transistor 102. It should be noted that $C_{el}$ is an electrostatic capacitance of the organic EL element 103, and $C_s$ is an electrostatic capacitance of the first capacitor 101. In the case of $V_{data}-V3>0$, the drive transistor 102 is turned on by applying the signal voltage ($V_{data}$) to the gate electrode of the drive transistor 102, and the source voltage of the drive transistor 102 varies due to a current supplied from the drive transistor 102. Thus, it is preferable that a time period during which the third switching transistor 113 is in a conductive state is short. In the above-described manner, it is possible to supply the drain-source current not depending on the threshold voltage of the drive transistor 102 from the drive transistor 102 to the organic EL element 103. At this time, the organic EL element emits light.

With the above-described series of operations, the organic EL element 103 emits light at a luminance corresponding to the signal voltage supplied from the signal line 130 in one frame period.

[1-3. Operation when Display is Stopped]

Next, an operation of the display device 1 according to the present embodiment, when display is stopped, shall be described with reference to FIG. 10.

Figure 10:
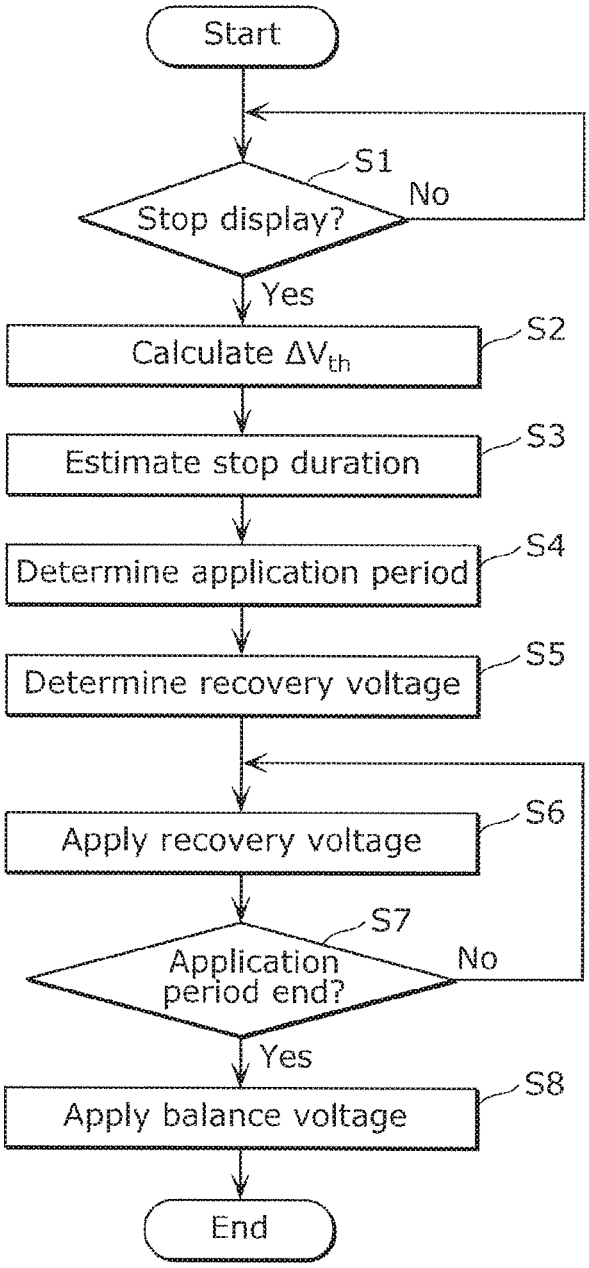
FIG. 10 is a flowchart illustrating an outline of an operation of the display device when display is stopped according to Embodiment 1.

FIG. 10 is a flowchart illustrating an outline of an operation of the display device 1 when display is stopped, according to the present embodiment.

As illustrated in FIG. 10, first, the control circuit 2 determines whether or not to stop display by the display unit 6 (S1). Here, this determination is carried out on the basis of (i) the presence or absence of a signal indicating an off operation of a main power switch of the display device 1 which is provided to the control circuit 2 from outside the control circuit 2, or (ii) the presence or absence of an input, to the control circuit 2, of video data to be transferred to the panel.

When display by the display unit 6 is not stopped (No in S1), the control circuit 2 again executes the process (S1) of determining whether or not to stop the display by the display unit 6.

When display by the display unit 6 is stopped (Yes in S1), the control circuit 2 calculates an amount of threshold voltage shift $\Delta V_{th}$ of the drive transistor 102 of each of the light-emitting pixels 100 (S2). Calculation of the amount of threshold voltage shift $\Delta V_{th}$ is carried out on the basis of the history of the gate-source voltage applied to the drive transistor 102 prior to the calculation. This history is recorded on the memory 3. Details of the method of calculation shall be described later.

Next, the control circuit 2 estimates duration (stop period) during which the display unit 6 is maintained in the stopped state (S3). This history is recorded on the memory 3. The stop period is estimated using, for example, user's usage history of the display device 1, etc. More specifically, the control circuit 2 records, on the memory 3, user's on/off operation history of the main power switch of the display device 1, and estimates the stop period on the basis of the history. For example, in the case where the on/off operation history indicates that the main power switch was turned off after 11 o'clock in the afternoon and it is known that the main power switch will not be turned on until 6 o'clock next morning, the stop period is estimated, if the main power switch was turned off after 11 o'clock in the afternoon, to be a time period from the off operation to 6 o'clock next morning. In addition, the control circuit 2 is capable of estimating the stop period on the basis of a signal from the monitoring unit 8. For example, even when the main power switch of the display device 1 is turned off, if a user stays in proximity to the display device 1 (and the display unit 6), the stop period may be estimated to be approximately 10 minutes, for example, assuming that it is highly likely that the main power switch is turned on within several tens of minutes.

The control circuit 2, subsequent to the estimating of the stop period, determines an application period during which a recovery voltage is applied (S4). As the application period, it is possible to select an arbitrary period of time of which duration is equal to or shorter than the estimated stop period, as long as the period of time is sufficient for recovering the threshold voltage of the drive transistor 102. However, as described above, the stop period is a value which is merely estimated, and there is a possibility that the main power switch is turned on before the estimated stop period elapses. In view of the above, in order to decrease the possibility of the main power switch being turned on during the application of the recovery voltage, a shortest period of time which is sufficient for recovering the threshold voltage may be adopted as the application period.

The control circuit 2, subsequent to the determining of the application period, determines a recovery voltage on the basis of (i) the threshold voltage of the drive transistor at the time when the main power switch is turned off and (ii) the determined application period (S5). The recovery voltage is calculated using a function obtained by modeling recovery of the threshold voltage, and determined to be a value which can cause the threshold voltage to be, at least calculatory, completely recovered. Details of the method of calculation shall be described later.

Next, the control circuit 2 applies the recovery voltage determined in the above-described manner, across the gate and source of the drive transistor 102 (S6). Details of the operation of the light-emitting pixel 100 during the application of the recovery voltage shall be described later.

The control circuit 2, after starting the application of the recovery voltage, continues to apply the recovery voltage until the end of the application period (No in S7). When the control circuit 2 detects, using an inner timer circuit or the like, that the application period has ended (Yes in S7), the control circuit 2 determines that recovery of the threshold voltage has been completed. Then, the control circuit 2 applies a balance voltage across the gate and source of the drive transistor 102 until the display unit 6 restarts display (S8), and ends the control operation by suppressing shifting of the threshold voltage of the drive transistor 102.

As described above, the main power switch of the display device 1 may be turned on, as needed, by a user. For that reason, in the case where the main power switch is turned on during each of the processes and between the processes in the flowchart illustrated in FIG. 10, interruption of the process of restarting display by the display unit 6 is permitted.

[1-4. Method of Calculating the Amount of Threshold Voltage Shift (Amount of Deterioration)]

Next, a method of calculating the amount of threshold voltage shift (amount of deterioration) shall be described.

First, a method of calculating the amount of threshold voltage shift $\Delta V_{th_d}$ (hereinafter referred to as "amount of deterioration") in a time period $t_d$ (hereinafter referred to as "deterioration period") during which a voltage for causing threshold voltage shift in a positive direction is applied across the gate and source of the drive transistor 102 shall be described with reference to FIG. 11.

Figure 11:
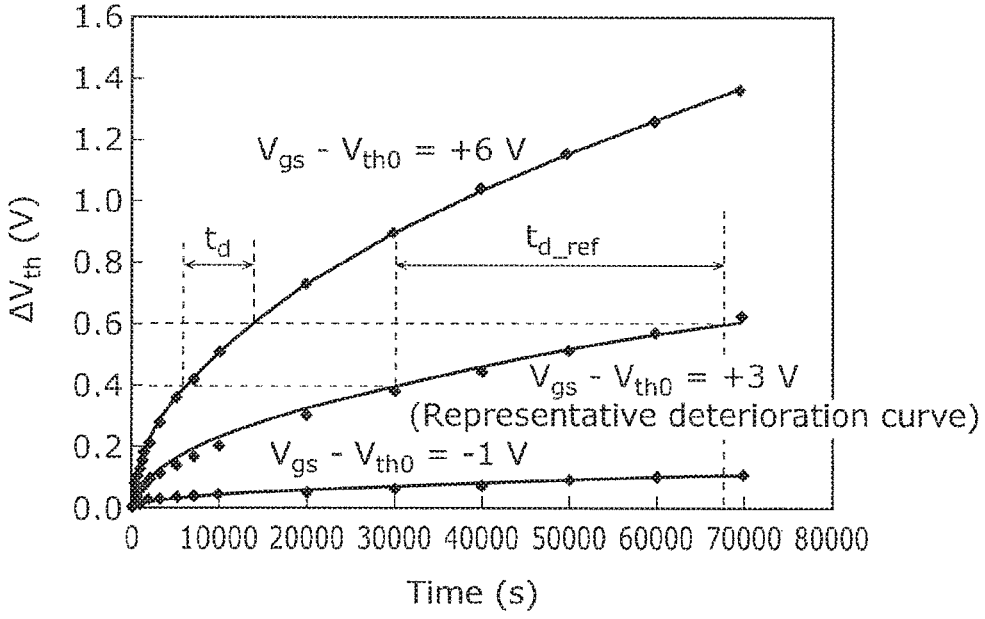
FIG. 11 is a graph illustrating a relationship between the amount of deterioration of the threshold voltage with respect to the time length of a deterioration period.

FIG. 11 is a graph illustrating a relationship between the amount of threshold voltage shift $\Delta V_{th}$ and the time length of the deterioration period $t_d$ in the case where a predetermined voltage $V_{gs}$ is applied across the gate and source of the drive transistor 102 including a semiconductor layer configured of an oxide semiconductor. FIG. 11 illustrates three patterns of the experimental result in which the voltages obtained by subtracting an initial threshold voltage $V_{th0}$ (threshold voltage before stress is applied) of the drive transistor 102 from the gate-source voltage $V_{gs}$ of the drive transistor 102 are +6V, +3V, and −1V.

Here, a method of expressing, in terms of a function, the amount of deterioration $\Delta V_{th_d}$ of the threshold voltage of the drive transistor 102, by fitting the graph of the experimental result illustrated in FIG. 11. In general, in the case where a constant voltage is applied across the gate and source of a TFT, the amount of deterioration $\Delta V_{th_d}$ of the threshold voltage is expressed by Expression 2 indicated below, where $V_{gs}$ denotes a gate-source voltage, $t_d$ denotes a time length of deterioration period, $V_{th0}$ denotes an initial threshold voltage (threshold voltage before stress is applied), $\tau$ denotes a time constant, and $\beta$ denotes a constant.

[Math. 2]

$$\Delta V_{th_d} = (V_{gs} - V_{th0})\left[1 - \exp\left\{-\left(\frac{t_d}{\tau}\right)^{\beta}\right\}\right] \quad \text{Expression 2}$$

Expression 2 indicated above is an expression representing the amount of deterioration when $V_{gs}$ is maintained to be a constant value, in which a function which causes the amount of deterioration to gradually approach $V_g$; $V_{th0}$ as the time length $t_d$ of the deterioration period increases is used. However, in the drive transistor 102 of the display device 1, since the drain-source current is maintained substantially to a constant value when a signal voltage is constant, the gate-source voltage $V_{gs}$ is not maintained to be a constant value. In other words, a voltage corrected according to the amount of threshold voltage shift (amount of deterioration) is applied across the gate and source, and thus $V_{gs}$ becomes a voltage value that changes according to the amount of threshold voltage shift (amount of deterioration). In view of the above, the right-hand side of Expression 2 indicated above is expanded using Maclaurin series, and modified to Expression 3 indicated below that is suitable for the case of maintaining the drain-source current substantially constant.

[Math. 3]

$$\Delta V_{th_d} = A(V_{gs} - V_{th0} + V_{offset})^{\alpha} t_d^{\beta} \quad \text{Expression 3}$$

Here, A, $\alpha$, $\beta$, and $V_{offset}$ are each a constant obtained by fitting the graph of the experimental result illustrated in FIG. 11.

It is possible to calculate the amount of deterioration $\Delta V_{th_d}$ in the case where a predetermined gate-source voltage $V_{gs}$ is applied for a predetermined deterioration period (time period $t_d$).

As described above, the drain-source current is maintained substantially constant when the signal voltage is constant. However, in general, the signal voltage is not always constant in the display device 1, and thus it is necessary, when the signal voltage varies, to calculate the amount of deterioration of each of the cases where the respective signal voltages are applied, using Expression 3. Furthermore, even in the case where the same gate-source voltage $V_{gs}$ is applied, the amount of deterioration differs according to the degree of deterioration (i.e., an accumulated amount of deterioration) of the drive transistor 102 at the time of application. In view of this, a representative deterioration curve is used in order to calculate the amount of deterioration in the case where an arbitrary gate-source voltage is applied for a predetermined period of time, with the effect of the accumulated amount of deterioration being reflected. The representative deterioration curve is a curve representing an amount of deterioration with respect to the time length of the deterioration period when the reference voltage $V_{gs_ref}$ is applied across the gate and source. That is, the time axis of the graph illustrated in FIG. 11 that shows the amount of deterioration with respect to the time length of the deterioration period obtained in a case where an arbitrary gate-source voltage is applied is converted so as to match the representative deterioration curve. For example, in FIG. 11, the deterioration curve in the case of $V_{gs}-V_{th0}=+3$ V is selected as the representative deterioration curve. Here, in the case where the state of $V_{gs}-V_{th0}=+6$ V is maintained for the time period $t_d$ of the deterioration period and the amount of threshold voltage shift $\Delta V_{th}$ deteriorates from 0.4 V to 0.6 V, this time length $t_d$ of the deterioration period is converted into a converted time $t_{d_ref}$ which it takes for the threshold voltage to deteriorate from 0.4 V to 0.6 V on the representative deterioration curve.

In this manner, the amount of deterioration in a case where an arbitrary gate-source voltage is applied over the time length $t_d$ of the deterioration period is calculated as the amount of deterioration in the case where the reference voltage is applied over a converted time. This makes it possible to express, on the representative deterioration curve, the amount of deterioration in the case where an arbitrary gate-source voltage is applied.

A method for calculating the converted time $t_{d_ref}$ shall be described below. Based on Expression 3 indicated above, the amount of deterioration $\Delta V_{th_ref}$ in the case where the reference voltage $V_{gs_ref}$ is applied over the converted time $T_{d_ref}$ is expressed by Expression 4 below.

[Math. 4]

$$\Delta V_{th_ref}=A(V_{gs_ref}-V_{th0}+V_{offset})^{\alpha}t_{d_ref}^{\beta} \quad \text{Expression 4}$$

Accordingly, assume that the above-described amount of deterioration $\Delta V_{th_ref}$ is equal to the amount of deterioration $\Delta V_{th_d}$ expressed by Expression 3 in the case where an arbitrary gate-source voltage $V_{gs}$ is applied for the time period $t_d$, the converted time $t_{d_ref}$ is expressed by Expression 5 below based on Expression 3 and Expression 4.

[Math. 5]

$$t_{d_ref}=\left(\frac{V_{gs_ref}-V_{th0}+V_{offset}}{V_{gs_d}-V_{th0}+V_{offset}}\right)^{-\frac{\alpha}{\beta}}t_d \quad \text{Expression 5}$$

This makes it possible to convert the time period $t_d$ of the deterioration period into the converted time $t_{d_ref}$. Therefore, even in the case where the gate-source voltage varies, the amount of deterioration can be expressed only by the representative deterioration curve by converting the time length $t_d$ of the deterioration period into the converted time $t_{d_ref}$. It should be noted that the accumulated amount of deterioration is calculated by calculating the accumulated converted time which is sum of the converted times $t_{d_ref}$ and finding the amount of threshold voltage shift at a point on the representative deterioration curve that corresponds to the accumulated converted time.

[1-5. Method of Calculating the Amount of Threshold Voltage Shift (Amount of Recovery)]

Next, a method for calculating the amount of threshold voltage shift (hereinafter referred to as "the amount of recovery") in the case where a recovery voltage is applied across the gate and source of the drive transistor 102. Based on the graph that shows a relationship between the amount of recovery of the threshold voltage of the drive transistor 102 and the time length of the application period, the amount of recovery $\Delta V_{th_r}$ is expressed by Expression 6 indicated below, where $\Delta V_{th_end}$ is the amount of threshold voltage shift at the start of applying a recovery voltage and $t_r$ is the time length of the application period.

[Math. 6]

$$\Delta V_{th_r}=(V_{gs}-V_{th_end})\left[1-\exp\left\{-\left(\frac{t_r}{\tau}\right)^{\gamma}\right\}\right] \quad \text{Expression 6}$$

Here, the time constant $\tau$ is expressed by Expression 7 indicated below, where $\tau 0$ is a coefficient, $E\tau$ is activation energy of the time constant $\tau$ of the threshold voltage shift which occurs as a result of applying the recovery voltage of the drive transistor 102, k is a Boltzmann constant, and $\tau$ is temperature.

[Math. 7]

$$\tau=\tau_0\exp\left(\frac{E_\tau}{kT}\right) \quad \text{Expression 7}$$

Here, $\gamma$ in Expression 6 is a constant obtained from the experimental result.

Therefore, the recovery voltage to be applied is obtained by assigning the application period and the amount of threshold voltage to be recovered ($\Delta V_{th_r}$) to the above-indicated Expression 6 and Expression 7.

[1-6. Calculation of the Amount of Threshold Voltage Shift Using a Representative Deterioration Curve]

Next, a method for calculating the amount of deterioration and the amount of recovery using the representative deterioration curve shall be described with reference to FIG. 12 and FIG. 13.

Figure 12:
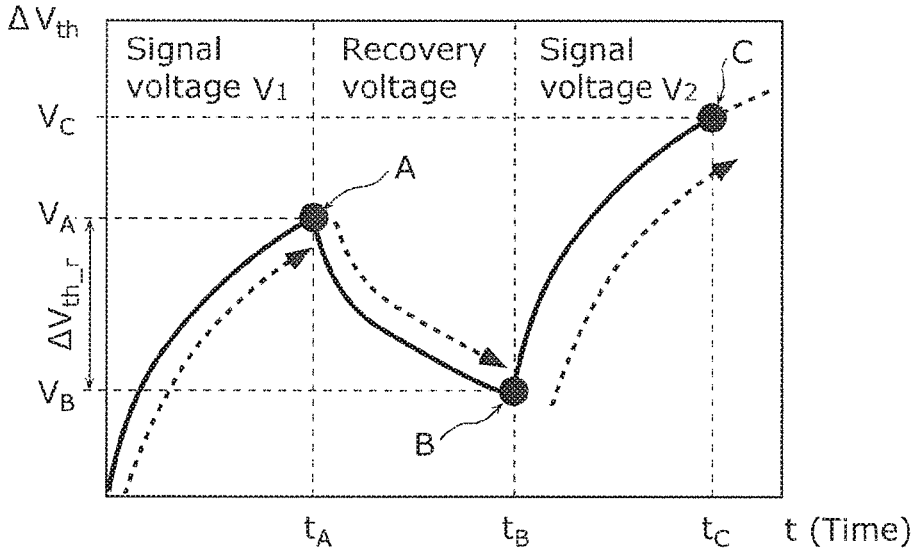
FIG. 12 is a graph illustrating an outline of the change over time of an amount of threshold voltage shift in the case where a signal voltage applied to the drive transistor varies.

FIG. 12 is a graph illustrating an outline of the change over time of an amount of threshold voltage shift in the case where a signal voltage applied to the drive transistor 102 varies.

Figure 13:
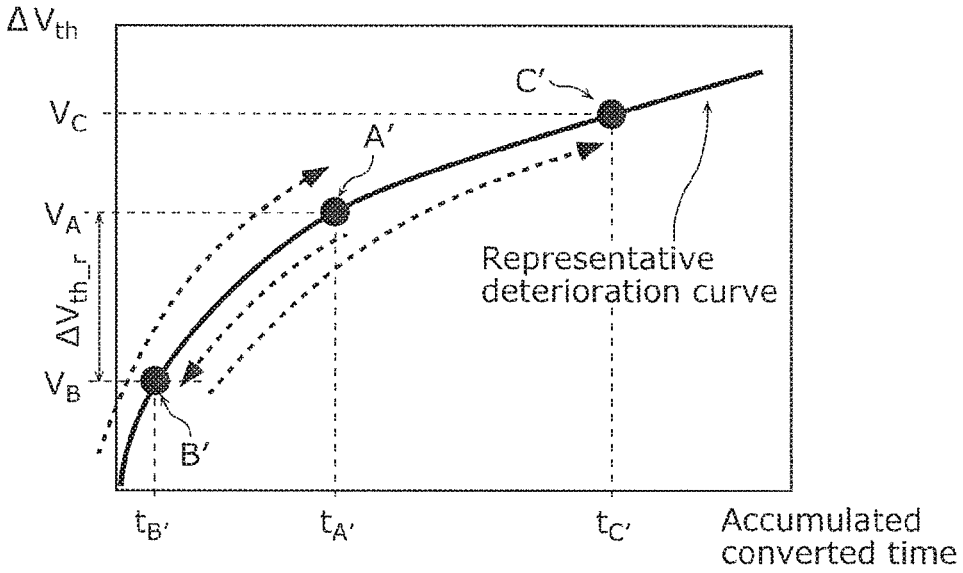
FIG. 13 is a graph illustrating how a point on a representative deterioration curve moves in the case where the signal voltage applied to the drive transistor varies.

FIG. 13 is a graph illustrating how a point on a representative deterioration curve moves in the case where the signal voltage applied to the drive transistor 102 varies as illustrated in FIG. 12.

First, a method of calculating an amount of deterioration in the case where a signal voltage is applied to the signal line 130 of the light-emitting pixel 100. For example, assume that a signal voltage $V_1$ is applied during a period from a time t=0 to a time $t=t_A$ as illustrated in the graph of FIG. 12, the control circuit 2 converts the time length $t_A$ of the deterioration period into a converted time $t_{A'}$ on the basis of Expression 5. In this case, application of the signal voltage starts from the time t=0, and thus an accumulated converted time at the start of the deterioration period is zero. Accordingly, an accumulated converted time at the end of application of the signal voltage is $0+t_{A'}=t_{A''}$. Then, the control circuit 2 calculates an amount of threshold voltage shift $V_A$ on the basis of a value on the vertical axis corresponding to a point (A') whose value on the horizontal axis is the accumulated converted time $t_{A'}$ with reference to the representative deterioration curve illustrated in FIG. 13. In this manner, the control circuit 2 calculates the amount of threshold voltage shift $V_A$ at the end of the deterioration period.

Next, a method of calculating the amount of recovery in the case where a recovery voltage is applied across the gate and source of the drive transistor 102 shall be described. For example, as illustrated in the graph of FIG. 12, the control circuit 2 applies a recovery voltage across the gate and source of the drive transistor 102 from the time $t=t_A$ to a time $t=t_6$, the threshold voltage recovers by the amount of recovery $\Delta V_{th_r}$ ($=V_A-V_B$). Therefore, the control circuit 2 calculates the amount of recovery $\Delta V_{th_r}$ of the threshold voltage, using the above-indicated Expressions 6 and 7. Then, the control circuit 2 calculates, as an accumulated converted time at the end of the application period, a value $t_{B'}$ which is a value of the horizontal axis corresponding to a point B' on the representative deterioration curve, at which the amount of threshold voltage shift is $V_B$ (a value that has decreased from $V_A$ by $\Delta V_{th_r}$) with reference to the representative deterioration curve as illustrated in FIG. 13. In this manner, the control circuit 2 calculates the accumulated converted time and the amount of threshold voltage shift at the end of the application period.

As described above, when the example illustrated in FIG. 12 and FIG. 13 is used, the amount of recovery of the threshold voltage during the application period (from $t_A$ to $t_B$) can also be expressed by movement of a point on the representative deterioration curve. Furthermore, also in the case where a deterioration period (a period from the value $t_B$ of the point B on the time axis to the value $t_C$ of the point C on the time axis in FIG. 12) in which a signal voltage $V_2$ is applied after the end of the application period, the amount of threshold voltage shift at the end of the deterioration period can be calculated on the basis of the representative deterioration curve. That is, an accumulated converted time $t_{C'}$ at the end $t_C$ of the deterioration period is calculated by converting the length ($t_C-t_B$) of the deterioration period illustrated in FIG. 12 into a converted time ($t_{C'}-t_{B'}$) illustrated in FIG. 13. Then, the amount of threshold voltage shift $V_C$ at the end of the deterioration period can be calculated on the basis of a value, on the vertical axis, of the point C on the representative deterioration curve that corresponds to the accumulated converted time $t_{C''}$.

In this manner, the threshold voltage shift in each of the deterioration period and an application period can be calculated, using the representative deterioration curve.

[1-7. Operation of a Light-Emitting Pixel when a Recovery Voltage is Applied]

Next, an operation of the light-emitting pixel 100 during the above-described recovery voltage applying process (S6 in FIG. 10) shall be described.

First, an operation of the light-emitting pixel 100 at the time when a threshold voltage is detected during the recovery voltage applying process shall be described with reference to FIG. 14 and FIG. 15.

Figure 14:
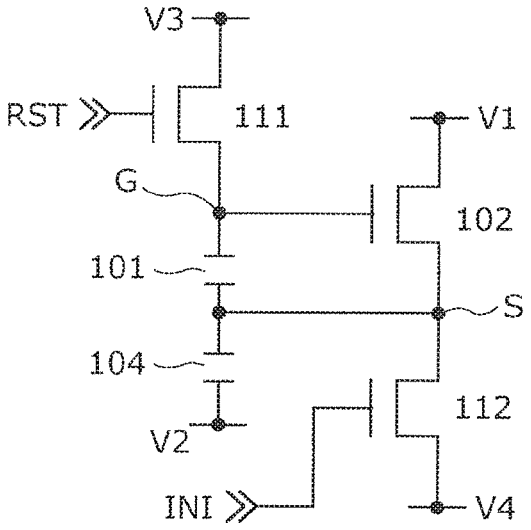
FIG. 14 is a circuit diagram selectively illustrating elements in a light-emitting pixel that are used when a threshold voltage is detected in the display device according to Embodiment 1.

FIG. 14 is a circuit diagram selectively illustrating, among elements included in the light-emitting pixel 100 illustrated in FIG. 9, elements that are used when detecting a threshold voltage.

Figure 15:
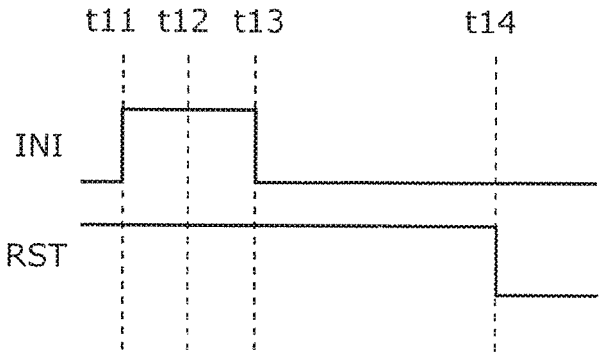
FIG. 15 is a timing chart illustrating a circuit operation when a threshold voltage is detected in the display device according to Embodiment 1.

FIG. 15 is a timing chart illustrating the operation of the circuit illustrated in FIG. 14.

It should be noted that, although the second capacitor 104 is connected to the source electrode of the drive transistor 102 in the circuit illustrated in FIG. 14, the second capacitor 104 may be newly added, or a capacitance component of the organic EL element 103 may be used as the second capacitor 104. Here, an operation performed in the case where the gate-source voltage of which $V_{gs}$ $V_{th}=-4$ V is established is applied as a recovery voltage, using the drive transistor having the characteristics illustrated in FIG. 7 shall be described as an example. In this case, it is possible to select, as a voltage to be applied to each of the power lines, 10 V as the voltage V1, 0 V as the voltage V2, 5 V as the voltage V3, and 0 V as the voltage V4, for example. It should be noted that the voltage V3−V4 is set to be a value greater than the threshold voltage $V_{th}$ of the drive transistor 102.

In FIG. 14 and FIG. 15, INI denotes a signal applied to the gate electrode of the second switching transistor 112, and RST denotes a signal applied to the gate electrode of the first switching transistor 111.

As illustrated in FIG. 15, the control circuit 2, first, sets an RST signal and an INI signal to a high level at a time t11 such that the first switching transistor 111 and the second switching transistor 112 are placed in a conductive state. In this manner, a source potential of the drive transistor 102 is set to V4 (=0 V) and a gate potential of the drive transistor 102 is set to V3 (=5 V). This causes a voltage V3−V4 (=5V) is applied to the ends of the first capacitor 101, and a voltage applied to the second capacitor 104 reaches zero according to V2=V4=0. This state is maintained until a time t13, and only the INI signal is set to a low level at the time t13. Then, since the gate-source voltage of the drive transistor 102 is greater than a threshold voltage $V_{th}$, a current flows from the drain to the source of the drive transistor 102. The second capacitor 104 is charged with this current, leading to an increase in the source potential of the drive transistor 102. Then, when the gate-source voltage of the drive transistor 102 becomes equal to the threshold voltage $V_{th}$ of the drive transistor 102 (i.e., when the source potential becomes V3−$V_{th}$), the drive transistor 102 is placed in a non-conductive state between the drain and the source, and thus the increase in the source potential is stopped.

As described above, it is possible to detect the threshold voltage $V_{th}$ of the drive transistor 102. In addition, it is possible to set the RST signal to a low level at the time t14 after the end of detection of the threshold voltage $V_{th}$.

Moreover, it is also possible to set the RST signal to a low level until the time t12 between the time t11 and the time t13. In this case, a voltage applied to the second capacitor 104 reaches zero between the time t11 and the time t12. In this case, a voltage applied to the first capacitor 101 becomes V3−V2 between the time t12 and the time t13. Accordingly, it is possible to detect the threshold voltage $V_{th}$ of the drive transistor 102 even in the case where the RST signal is set to a low level from the time t11 to the time t12.

Next, an operation of the light-emitting pixel 100 when a recovery voltage is applied across the gate and source of the drive transistor 102 shall be described with reference to FIG. 16 and FIG. 17.

Figure 16:
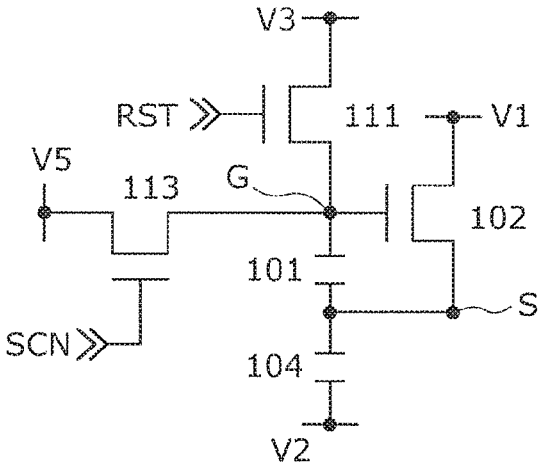
FIG. 16 is a circuit diagram selectively illustrating elements in a light-emitting pixel that are used when a recovery voltage is applied in the display device according to Embodiment 1.

FIG. 16 is a circuit diagram selectively illustrating, among elements included in the light-emitting pixel 100 illustrated in FIG. 9, elements that are used when applying a recovery voltage.

Figure 17:
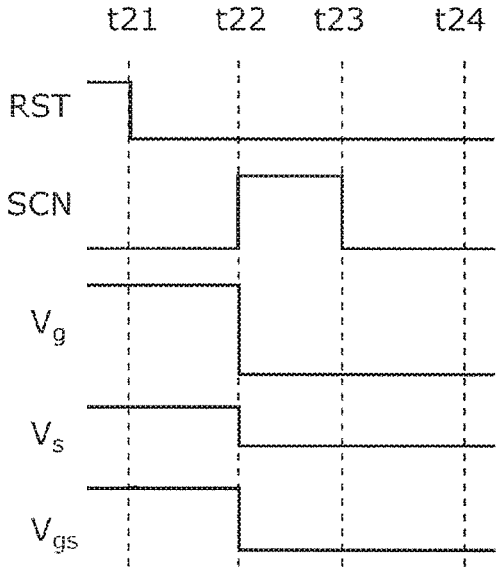
FIG. 17 is a timing chart illustrating a circuit operation when a recovery voltage is applied in the display device according to Embodiment 1.

FIG. 17 is a timing chart illustrating the operation of the circuit illustrated in FIG. 16.

It should be noted that, although the second capacitor 104 is connected to the source electrode of the drive transistor 102 in the circuit illustrated in FIG. 16, the second capacitor 104 may be newly added, or a capacitance component of the organic EL element 103 may be used as the second capacitor 104. In addition, it is possible to select, as a voltage to be applied to each of the power lines, 10 V as the voltage V1, 0 V as the voltage V2, and 5 V as the voltage V3, for example. In addition, the voltage V5 applied to the signal line 130 may be 0V, for example.

In FIG. 16 and FIG. 17, SCN denotes a signal applied to the gate electrode of the third switching transistor 113. As illustrated in FIG. 17, the control circuit 2, first, sets an RST signal to a low level at a time t21 such that the first switching transistor 111 is placed into a non-conductive state from the conductive state. It should be noted that the above-described operation of detecting the threshold voltage has been completed at the time t21, and the source potential $V_s$ of the drive transistor 102 is V3$-V_{th}$, and the gate potential $V_g$ of the drive transistor 102 is V3. Next, when the SCN signal is changed from the low level to the high level at the time t22, the gate potential $V_g$ of the drive transistor 102 decreases from V3 (=5 V) to V5 (=0 V) by a potential difference V3−V5 (=5 V), as illustrated in FIG. 17. At this time, the voltage applied to the ends of the first capacitor 101 varies. Here, when the capacitance of the first capacitor 101 and the capacitance of the second capacitor 104 are selected such that the ratio of the capacitance of the first capacitor 101 to the capacitance of the second capacitor 104 is 1:4, for example, the ratio of an amount of variation in the voltage applied to the first capacitor 101 to an amount of variation in the voltage applied to the second capacitor 104 is 4:1. Accordingly, an amount of decrease in the voltage applied to the end of the first capacitor 101 is 4 V that is the four fifths of V3−V4. Accordingly, the gate-to-source voltage $V_{gs}$ is $V_{th}-4$ at and after the time t22. Thus, $V_{gs}-V_{th}=-4$ V is established, and the state in which the above-described recovery voltage is applied across the gate and source of the drive transistor 102 is obtained (see FIG. 7, etc.) Subsequently, the gate-source voltage of the drive transistor 102 is maintained even when the SCN signal is set to the low level.

As described above, the recovery voltage is applied across the gate and source by operating the light-emitting pixel4 100 when display by the display unit 6 is stopped.

It should be noted that the above-described recovery voltage is applied sequentially to each of the light-emitting pixels 100 in the display unit 6. However, the recovery voltage may be applied concurrently to all the light-emitting pixels 100.

[1-8. Balance Voltage Application Process]

Next, an operation of the light-emitting pixel 100 during the above-described balance voltage applying process (S8 in FIG. 10) shall be described.

The operation of the light-emitting pixel 100 during the above-described balance voltage applying process is carried out in the same manner as the above-described recovery voltage application process. More specifically, in the case where, for example, a gate-source voltage of which $V_{gs}-Vth=-2$ V is established is applied as a balance voltage, using the drive transistor having the characteristics illustrated in FIG. 7, 2.5 V may be selected as the above-described voltage V3.

In this manner, it is possible to apply the balance voltage, thereby enabling suppressing of the threshold voltage shift.

It should be noted that the balance voltage need not be the gate-source voltage whose amount of threshold voltage shift is zero. For example, a tolerance amount of the threshold voltage shift may be determined, and an error in a range corresponding to the tolerance amount may be included. Alternatively, an error to the degree of accuracy of voltage adjustment of the above-described V3 may be permitted.

[1-9. Advantageous Effects, Etc.]

As described above, when display by the display unit 6 is stopped, the threshold voltage of the drive transistor 102 is recovered by applying a recovery voltage and a balance voltage across the gate and source of the drive transistor 102. In addition, since the applied voltage is sufficiently applied on the basis of the threshold voltage and the application period of the drive transistor 102 according to the present embodiment, it is possible to suppress the state in which recovery of the threshold voltage is insufficient, and the threshold voltage shifts in the negative direction with respect to an initial value of the threshold voltage due to excessive application of the recovery voltage.

In addition, according to the present embodiment, since the amount of threshold voltage shift is calculated on the basis of history of applied voltage across the gate and source, it is possible to obtain the amount of threshold voltage shift without measurement. With this, it is possible to obtain the amount of threshold voltage shift without providing the light-emitting pixel 100 with a line for use in measurement.

In addition, according to the present embodiment, when display by the display unit 6 is stopped, a stop period during which the display is maintained in the stopped state is estimated, and the application period of the recovery voltage is determined on the basis of the stop period, leading to decrease in the possibility of restarting display by the display unit 6 during application of the recovery voltage.

In addition, according to the present embodiment, since recovery voltages which correspond one to one to the light-emitting pixels 100 are obtained, it is possible to apply optimal recovery voltages each corresponding to the amount of threshold voltage shift of each of the light-emitting pixels 100.

(Modification 1)

Next, Modification 1 of Embodiment 1 shall be described with reference to FIG. 18 and FIG. 19.

Figure 18:
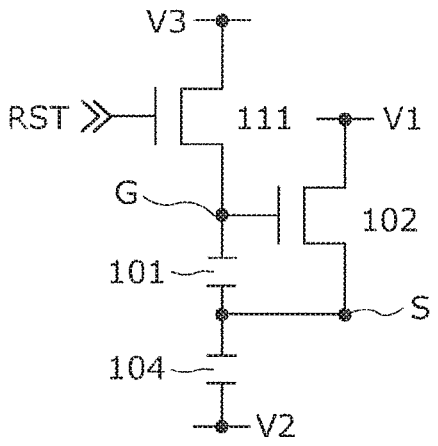
FIG. 18 is a circuit diagram selectively illustrating an element in a light-emitting pixel that is used when a recovery voltage is applied in the display device according to Modification 1 of Embodiment 1.

FIG. 18 is a circuit diagram selectively illustrating, among elements included in the light-emitting pixel 100 illustrated in FIG. 9, elements that are used when applying a recovery voltage according to the present modification.

Figure 19:
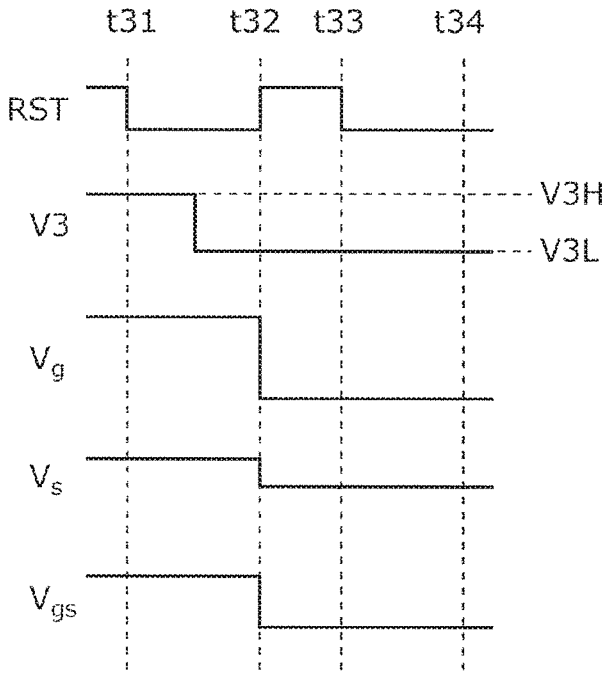
FIG. 19 is a timing chart illustrating a circuit operation when a recovery voltage is applied in a display device according to Modification 1 of Embodiment 1.

FIG. 19 is a timing chart illustrating the operation of the circuit illustrated in FIG. 18.

The present modification is different from the foregoing Embodiment 1, in the operation performed when a recovery voltage is applied. It should be noted that, in the same manner as Embodiment 1, the ratio of the capacitance of the first capacitor 101 to the capacitance of the second capacitor 104 is, for example, 1:4 in the present modification. In addition, it is possible to select, as a voltage to be applied to each of the power lines, 10 V as the voltage V1 and 0 V as the voltage V2, for example. Furthermore, the voltage V3 can be switched between a high level and a low level, and it is possible to select 5 V as a value V3H in the case of the high level, and 0 V as a value V3L in the case of the low level.

As illustrated in FIG. 19, the control circuit 2, first, sets an RST signal to a low level at a time t31 such that the first switching transistor 111 is placed into a non-conductive state from the conductive state. It should be noted that the above-described operation of detecting the threshold voltage has been completed at the time t31, and the source potential $V_s$ of the drive transistor 102 is V3H−$V_{th}$, and the gate potential $V_g$ of the drive transistor 102 is V3H. Next, the potential V3 is switched from V3H to V3L in a period from the time t31 to the time t32. Subsequently, when the RST signal is switched from the low level to the high level at the time t32, the gate potential $V_g$ of the drive transistor 102 decreases by a potential difference V3H−V3L (=5V), from V3H (=5V) to V3L (=0V), as illustrated in FIG. 19. At this time, the voltage applied to the ends of the first capacitor 101 varies. Accordingly, as with the case of Embodiment 1, the gate-to-source voltage $V_{gs}$ is $V_{th}$−4 at and after the time t32. Thus, $V_{gs}-V_{th}=-4$ is established, and the state in which the above-described balance voltage is applied across the gate and source of the drive transistor 102 is obtained. Subsequently, the gate-source voltage of the drive transistor 102 is maintained even when the RST signal is set to the low level at the time t33.

It should be noted that, in the period from the time t31 to the time t32, it is possible to obtain an equivalent advantageous effect even when the RST signal is maintained to the high level.

In addition, the above-described application of a recovery voltage may be carried out sequentially to each of the light-emitting pixels 100 of the display unit 6, or concurrently to all the light-emitting pixels 100.

As described above, the same advantageous effect as the foregoing Embodiment 1 can be obtained in the present modification as well.

(Modification 2)

Next, Modification 2 of Embodiment 1 shall be described with reference to FIG. 20.

Figure 20:
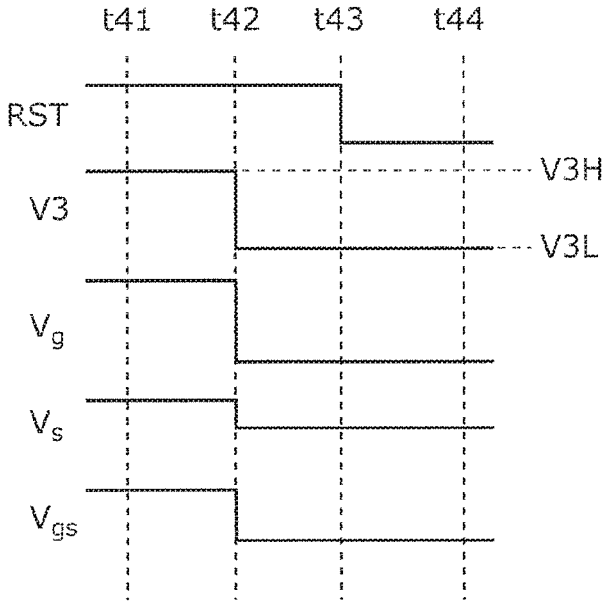
FIG. 20 is a timing chart illustrating a circuit operation when a recovery voltage is applied in a display device according to Modification 2 of Embodiment 1.

FIG. 20 is a timing chart illustrating the operation of the circuit illustrated in FIG. 18 according to the present modification.

The present modification is different from the above-described Modification 1, in a timing of switching the voltage V3 and the RST signal. As illustrated in FIG. 20, the present modification employs, in order to decrease the gate potential $V_g$ of the drive transistor 102 from V3H to V3L, a configuration in which the potential V3 is switched from V3H to V3L, in place of the configuration illustrated in FIG. 19 in which the RST signal is used. The same advantageous effect as the foregoing Embodiment 1 can be obtained in the present modification as well.

(Modification 3)

Next, Modification 3 of Embodiment 1 shall be described with reference to FIG. 21.

Figure 21:
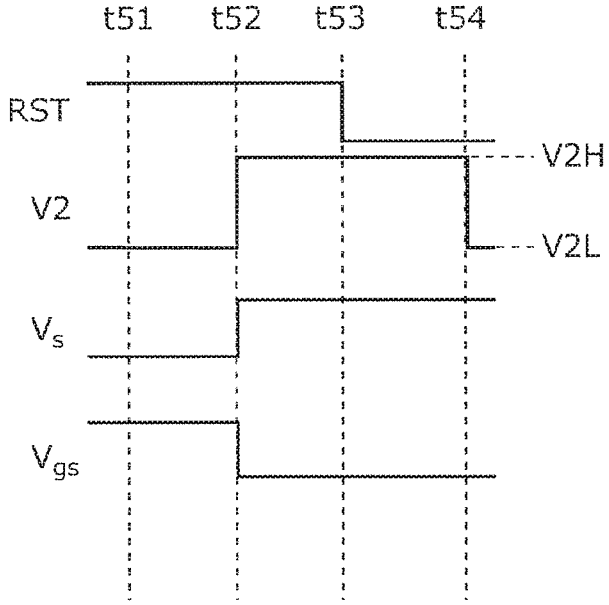
FIG. 21 is a timing chart illustrating a circuit operation when a recovery voltage is applied in a display device according to Modification 3 of Embodiment 1.

FIG. 21 is a timing chart illustrating the operation of the circuit illustrated in FIG. 18 according to the present modification.

The present modification is different from the above-described Modification 2, in an operation of the power line. As illustrated in FIG. 21, the present modification employs, in order to decrease the gate-source voltage of the drive transistor 102, a configuration in which the voltage V2 is switched from V2L (=0 V) to V2H (=5 V) at a time t52, in place of the configuration in which the gate potential is decreased. The same advantageous effect as the foregoing Embodiment 1 can be obtained in the present modification as well.

(Modification 4)

Next, Modification 4 of Embodiment 1 shall be described with reference to FIG. 22 and FIG. 23.

Figure 22:
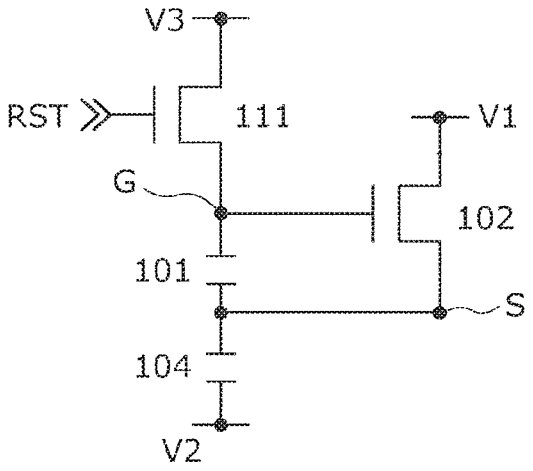
FIG. 22 is a circuit diagram selectively illustrating elements in a light-emitting pixel that are used when a threshold voltage is detected in a display device according to Modification 4 of Embodiment 1.

FIG. 22 is a circuit diagram selectively illustrating, among elements included in the light-emitting pixel 100 illustrated in FIG. 9, elements that are used when detecting a threshold voltage according to the present modification.

Figure 23:
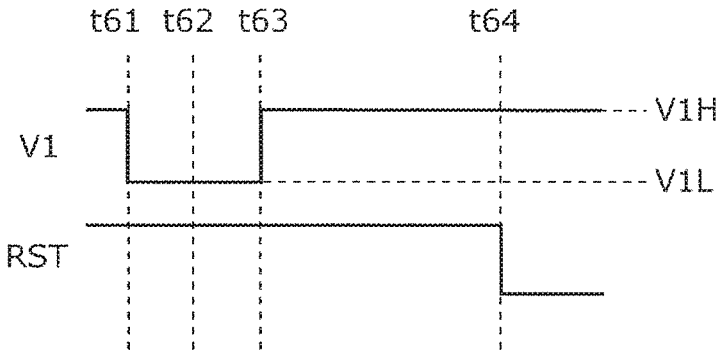
FIG. 23 is a timing chart illustrating a circuit operation when a threshold voltage is detected in the display device according to Modification 4 of Embodiment 1.

FIG. 23 is a timing chart illustrating the operation of the circuit illustrated in FIG. 22.

The present modification is different from the foregoing Embodiment 1, in the operation of detecting a threshold voltage. It is possible to select, as a voltage to be applied to each of the power lines, 0 V as the voltage V2, and 5 V as the voltage V3, for example. Furthermore, the voltage V1 can be switched between a high level and a low level, and it is possible to select 10 V as a value V1H in the case of the high level, and 0 V as a value V1L in the case of the low level. It should be noted that the voltage V3−V1L is set to be a value greater than the threshold voltage $V_{th}$ of the drive transistor 102, as with the foregoing Embodiment 1.

As illustrated in FIG. 23, the RST signal and the voltage V1 are at the high level until a time t61, and the gate potential of the drive transistor 102 is V3 (=5 V). Accordingly, the source potential of the drive transistor 102 is positive until the time t61. Here, when switching the voltage V1 from V1H (=10 V) to V1L (=0V) at the time t61, the source potential of the drive transistor 102 becomes higher than the drain potential of the drive transistor 102, and a conductive state is established between the source and the drain, causing a current flows from the source to the drain. After the source potential becomes the same as the drain potential and the current flowing from the drain to the source reaches zero, the voltage V1 is switched from V1L to V1H at the time t63. Here, the conductive state is also established between the source and the drain of the drive transistor 102, and thus a current flows from the drain to the source. At this time, the second capacitor 104 is charged, leading to an increase in the source potential of the drive transistor 102. Then, when the gate-source voltage of the drive transistor 102 becomes equal to the threshold voltage Vth of the drive transistor 102 (i.e., when the source potential becomes V3−$V_{th}$), the drive transistor 102 is placed in a non-conductive state between the drain and the source of the drive transistor 102. In this manner, it is possible to detect the threshold voltage $V_{th}$ of the drive transistor 102 according to the present modification, in the same manner as the foregoing Embodiment 1. In addition, it is possible to set the RST signal to the low level at the time t64 when a sufficient amount of time elapses for detecting the threshold voltage $V_{th}$.

Moreover, it is also possible to set the RST signal to the low level until the time t62 between the time t61 and the time t63, in the same manner as the foregoing Embodiment 1.

In addition, although the same voltage is supplied to one terminal of the second capacitor 104 and one terminal of the second switching transistor 112 according to the present modification, different voltages may be supplied.

Furthermore, in the present modification, it is possible to combine the operations of applying a recovery voltage according to the above-described modifications 1 to 3.

With this, the same advantageous effect as the foregoing Embodiment 1 can be obtained in the present modification as well.

Embodiment 2

Next, a display device according to Embodiment 2 shall be described.

The amount of threshold voltage shift of the drive transistor 102 is obtained by performing calculation using the above-described Expressions 2 to 7 according to the foregoing Embodiment 1. The present embodiment, however, employs a configuration in which the amount of threshold voltage shift is obtained by reading (measuring).

The following describes in detail a display device according to the present embodiment. However, descriptions of features common to the above-described Embodiment 1, such as the operation of light emission and the operation of the light-emitting pixel when applying a recovery voltage and a balance voltage shall be omitted.

[2-1. Configuration]

A display device according to the present embodiment has the same configuration as the configuration of the display device 1 according to the above-described Embodiment 1. However, features different from the features of the display device 1 according to the foregoing Embodiment 1, such as an operation of the control circuit 2, structural elements which may be added, etc. shall be described later.

[2-2. Operation when Display is Stopped]

First, an operation of the display device when display is stopped according to the present embodiment shall be described with reference to FIG. 24.

Figure 24:
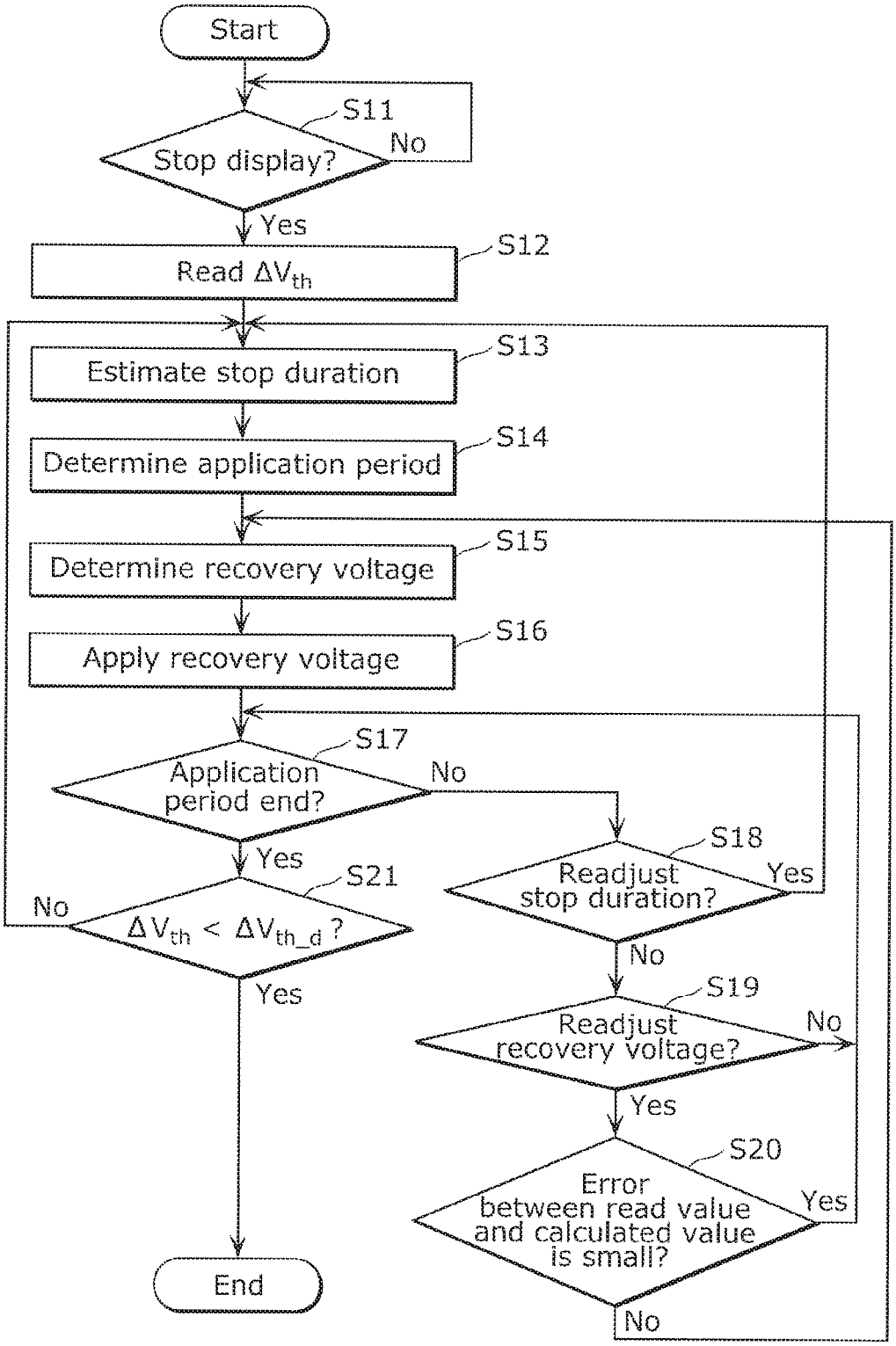
FIG. 24 is a flowchart illustrating an outline of an operation of a display device when display is stopped according to Embodiment 2.

FIG. 24 is a flowchart illustrating an outline of an operation of the display device when display is stopped, according to the present embodiment.

As illustrated in FIG. 24, first, the control circuit 2 determines whether or not to stop display by the display unit 6 (S11). Here, this determination is carried out on the basis of the presence or absence of a signal indicating an off operation of a main power switch of the display device which is provided to the control circuit 2 from outside the control circuit 2.

When display by the display unit 6 is not stopped (No in S11), the control circuit 2 executes the process (S11) of determining whether or not to stop the display by the display unit 6.

When display by the display unit 6 is to be stopped (Yes in S11), the control circuit 2 reads an amount of threshold voltage shift $\Delta V_{th}$ (S12). The reading of the amount of threshold voltage shift $\Delta V_{th}$ is carried out by measuring a voltage and a current which are supplied to each of the light-emitting pixels 100. Details of the method of reading shall be described later.

Next, the control circuit 2 estimates duration (stop period) during which the display unit 6 is maintained in the stopped state, in the same manner as the foregoing Embodiment 1 (S13).

The control circuit 2, subsequent to the estimating of the stop period, determines an application period during which a recovery voltage is applied, in the same manner as the foregoing Embodiment 1 (S14).

The control circuit 2, subsequent to the determining of the application period, determines a recovery voltage on the basis of (i) the threshold voltage of the drive transistor 102 at the time when the main power switch is turned off and (ii) the determined application period (S15). The recovery voltage is calculated in the same manner as the foregoing Embodiment 1. However, a value which has been read is used as the amount of threshold voltage shift, which is different from the foregoing Embodiment 1.

Next, the control circuit 2 applies the recovery voltage determined in the above-described manner, across the gate and source of the drive transistor 102 (S16).

The control circuit 2, after starting the application of the recovery voltage, determines whether or not the application period has ended (S17). Here, when the control circuit 2 determines that the application period has not ended (No in S17), the control circuit 2 determines whether or not to readjust the estimated stop period (S18). This determination may be carried out, for example, on the basis of a signal transmitted from the monitoring unit 8. When the monitoring unit 8 has detected a person in proximity to the display unit 6, it is highly likely that the main power switch of the display device will soon be turned on. Accordingly, the control circuit 2 may determine that it is necessary to readjust the stop period (Yes in S18), and returned to the process of estimating the stop period (S13).

When the control circuit 2 determines that it is not necessary to readjust the stop period (No in S18), the control circuit 2 determines whether or not to readjust the recovery voltage (S19). This determination is performed so as to prevent discrepancy between the threshold voltage calculated using the above-described Expressions 6 and 7 and an actual threshold voltage. The control circuit 2 may perform this determination on a regular basis, using a timer circuit, for example. The time internal of the determination may be set to one hour, for example. When the control circuit 2 determines that the recovery voltage is not to be readjusted (No in S19), the control circuit 2 returns to the process of determining whether or not the application period has ended (S17). When the control circuit 2 determines that the recovery voltage is to be readjusted (Yes in S19), the control circuit 2 determines whether or not an error between the amount of threshold voltage shift which has been read and the amount of threshold voltage shift which has been calculated from the above-described Expression 6 and Expression 7 is greater than a predetermined value (S20). Here, the predetermined value may be determined suitably, and may be determined to be less than resolution of an applied voltage of the signal line drive circuit.

When the control circuit 2 determines that the above-described error is less than the predetermined value (Yes in S20), the control circuit 2 returns to the process of determining whether or not the application period has ended, without changing the recovery voltage (S17). When the control circuit 2 determines that the above-described error is not less than the predetermined value (No in S20), the control circuit 2 returns to the process of determining a recovery voltage for changing the recovery voltage (S15).

When the control circuit 2 determines, in the above-described process S17, that the application period has ended (Yes in S17), the control circuit 2 reads again the amount of threshold voltage shift to determine whether or not the read amount of threshold voltage shift is less than a predetermined amount of threshold voltage shift $\Delta V_{th_d}$ (S21). Here, the predetermined amount of threshold voltage shift $\Delta V_{th_d}$ can be set to a sufficiently small value which indicates that the amount of threshold voltage shift is substantially zero. For example, the predetermined amount of threshold voltage shift $\Delta V_{th_d}$ may be set to be less than the resolution of an applied voltage of the signal line drive circuit.

When the control circuit 2 determines that the read amount of threshold voltage shift $\Delta V_{th}$ is not less than the above-described predetermined amount of threshold voltage shift $\Delta V_{th_d}$ (No in S21), the control circuit 2 returns to the process of estimating of the stop period (S13) for re-determining the application period and the recovery period.

When the control circuit 2 determines that the read amount of threshold voltage shift $\Delta V_{th}$ is less than the above-described predetermined amount of threshold voltage shift $\Delta V_{th_d}$ (Yes in S21), the control circuit 2 ends the operation of applying the recovery voltage.

It should be noted that, although the process of applying the balance voltage after the end of application of the recovery voltage is omitted in the present embodiment, the balance voltage may be applied after the end of application of the recovery voltage as with the above-described Embodiment 1.

In addition, as with the above-described Embodiment 1, the main power switch of the display device may be turned on, as needed, by a user. For that reason, in the case where the main power switch is turned on during each of the processes and between the processes in the flowchart illustrated in FIG. 24, interruption of the process of restarting display by the display unit 6 is permitted.

[2-3. Method of Reading the Amount of Threshold Voltage Shift]

Next, a method of reading the amount of threshold voltage shift $\Delta V_{th}$ according to the present embodiment shall be described below.

When the amount of threshold voltage shift is to be read, it is possible to select, as a shape of a measurement sample for reading, a single body of the drive transistor 102 (TFT) or the entirety of the light-emitting pixel 100.

First, the following describes a method of reading the amount of threshold voltage shift $\Delta V_{th}$ when a single body of the drive transistor 102 is selected as the measurement sample.

The gate-source voltage $V_{gs}$ and the drain-source current $I_{ds}$ are measured to read a threshold voltage of the drive transistor 102. Here, the gate-source voltage $V_{gs}$ is measured by providing a line for measuring a voltage to the gate and the source of the drive transistor 102, for example. In addition, a dummy drive transistor may be provided to measure the gate-source voltage and the drain-source current of the dummy driving transistor. The dummy drive transistor is applied with stress equivalent to the stress applied to the drive transistor 102 in the light-emitting pixel 100, and the characteristics of the dummy drive transistor is measured, thereby making it possible to estimate the characteristics of the drive transistor 102 in the light-emitting pixel 100. The drain-source current $I_{ds}$ is measured by measuring a current flowing through the first power line 131 illustrated in FIG. 9. The current flowing through the first power line 131 may be measured by providing a dedicated line for measuring a current, or may be measured by providing the power line drive circuit 7 with an ammeter. Next, the control circuit 2 creates, on the basis of the measured gate-source voltage $V_{gs}$ and the drain-source current $I_{ds}$, a graph which indicates the characteristics between $(I_{ds})^{1/2}$ and $V_{gs}$, based on. Linear extrapolation is applied to this graph to obtain $V_{gs}$ at which $I_{ds}$ is zero. Then, the control circuit 2 obtains a difference $\Delta V_{gs}$ between the value of this $V_{gs}$ and an initial value of $V_{gs}$ (a value before stress is applied to the drive transistor 102), and reads the value $\Delta V_{gs}$ as the amount of threshold voltage shift $\Delta V_{th}$.

Next, the following describes a method of reading the amount of threshold voltage shift $\Delta V_{th}$ when the light-emitting pixel 100 is selected as the measurement sample.

In order to read a threshold voltage, first, $V_{data}$ and $I_{pix}$ of the light-emitting pixel 100 are measured where $V_{data}$ is a voltage to be applied to the signal line 130 in the light-emitting pixel 100 and $I_{pix}$ is a current that flows through the light-emitting pixel 100. $V_{data}$ is obtained by measuring a voltage of the signal line 130. $I_{pix}$ is substantially equivalent to the drain-source current of the drive transistor 102, and thus obtained by measuring a current that flows through the first power line 131, for example. The current that flows through the first power line 131 may be measured by providing a dedicated line for measuring a current, or may be measured by providing the power line drive circuit 7 with an ammeter. The control circuit 2 creates a graph that indicates the characteristics between $(I_{pix})^{1/2}$ and $V_{data}$, using the measured $V_{data}$ and $I_{pix}$. Here, a value of $V_{data}$ at which $I_{pix}$ is zero is obtained by applying linear extrapolation to the characteristics between $(I_{pix})^{1/2}$ and $V_{data}$ in the middle-to-low range (in a range from a middle gradation to a low gradation) of the voltage $V_{data}$. Then, a difference $\Delta V_{data}$ between the value of $V_{data}$ and an initial value of $V_{data}$ (a value before application of $\Delta V_{data}$, i.e., a value before stress is applied to the drive transistor 102) is obtained. Here, when the threshold voltage compensation coefficient is $\alpha_1$, and a write rate of the threshold voltage to the light-emitting pixel is $\gamma_1$, the following expression is established.

[Math. 8]

$$\frac{\gamma_1 \Delta V_{data}}{\alpha_1} = \Delta V_{th} \qquad \text{Expression 8}$$

It should be noted that the threshold voltage compensation coefficient $\alpha_1$ and the write rate $\gamma_1$ of the threshold voltage to the light-emitting pixel are defined as indicated below.

[Math. 9]

$$1 - \alpha_1 \equiv \frac{\Delta V_{gs}}{\Delta V_{th}} \qquad \text{Expression 9}$$

[Math. 10]

$$\gamma_1 \equiv \frac{\Delta V_{gs}}{\Delta V_{data}} \qquad \text{Expression 10}$$

In the above-indicated Expression 8, the threshold voltage compensation coefficient $\alpha_1$ is 1 in the case where the above-described $\Delta V_{data}$ is measured without performing the threshold voltage compensation. In addition, the write rate $\gamma_1$ is a constant determined when the light-emitting pixel 100 is designed. Accordingly, the amount of threshold voltage shift $\Delta V_{th}$ is read by assigning $\Delta V_{data}$ obtained from the graph indicating the characteristics between $(I_{pix})^{1/2}$ and $V_{data}$ to Expression 8 when the threshold voltage compensation is not performed.

[2-4. Location of the Measurement Sample and the Characteristics]

Next, locations of measurement samples used for reading the amount of threshold voltage shift and characteristics of each of the locations shall be described with reference to FIG. 25.

FIG. 25 is a table illustrating locations and characteristics of each of the locations of measurement samples used for reading the amount of threshold voltage shift. It should be noted that, in the table of FIG. 25, circles indicate applicable, and christcrosses indicate inapplicable.

First, locations of the measurement samples illustrated in FIG. 25 shall be described. As a location of the measurement sample, each of the light-emitting pixels (No. 1 in FIG. 25)

or a representative location of the display unit 6 (No. 2 and No. 3 in FIG. 25) can be selected. In addition, as the representative location, it is possible to select within display region (No. 2 in FIG. 25) or outside display region (No. 3 in FIG. 25). As a configuration in which a measurement sample is located in a representative location within the display region, for example, a configuration in which a light-emitting pixel 100 having a row number and a column number each being an even number is selected from among the light-emitting pixels 100 located in rows and columns, a configuration in which a remainder resulting from dividing the row number and the column number by an integer n that is at least two is an integer m (<n) that is at least one, etc. may be adopted. In addition, a configuration in which four of the light-emitting pixels 100 located at four corners of the display region may be adopted. As an example of disposing a measurement sample at a representative location outside the display region, a configuration in which a dummy pixel which is not used for display is provided outside the display region may be adopted. The dummy pixel may be disposed in proximity to the four corners of the display region.

Next, shapes of the above-described measurement samples illustrated in FIG. 25 shall be described. As illustrated in FIG. 25, in the case where the above-described locations of the measurement samples are adopted, any of the light-emitting pixel and a single body of the drive transistor (a single body of a TFT) may be used as the shape of the measurement sample. When a dummy pixel is provided outside the display region (No. 3 in FIG. 25), it is preferable to provide the dummy pixel between the scanning line drive circuit 4 and the display unit 6. This makes it possible to supply the dummy pixel with a scanning signal, without separately providing a scanning line for the dummy pixel. In addition, as illustrated in FIG. 25, any of the light-emitting pixel and a single body of a TFT can be adopted as the shape of the measurement sample. However, in the case where the location of the measurement sample is within the display region (No. 1 and No. 2 in FIG. 25) and a single body of the drive transistor (a single body of a TFT) is adopted as the shape of the measurement sample, it is necessary to provide a dummy drive transistor, etc. in the light-emitting pixel 100. Accordingly, in the case where it is required to reduce the size of the light-emitting pixel 100 and increase in the definition of the display unit 6, it is preferable that a light-emitting pixel is adopted as the shape of the measurement sample.

The following describes a method of generating a $\Delta V_{th}$ map of the amount of threshold voltage shift illustrated in FIG. 25. As the $\Delta V_{th}$ map, a method of generating data of $\Delta V_{th}$ for each of the all light-emitting pixels within the display region of the display unit 6, and a method of generating data of $\Delta V_{th}$ for each of regions (A) obtained by dividing the display region into one or more regions (A) are conceivable. In any of the cases where the measurement samples of No. 1 to No. 3 in FIG. 25 are adopted, the above-described method of generating may be adopted. However, in the case where the representative location is the location of the measurement sample (No. 2 and No. 3 in FIG. 25), $\Delta V_{th}$ is an estimated value in which a measurement result obtained from the measurement sample of the representative location is used. The method of estimating $\Delta V_{th}$ is not specifically limited. For example, in the case where the light-emitting pixels located at four corners of the display region are locations of the measurement samples, $\Delta V_{th}$ of each of the light-emitting pixels (or each of the regions (A)) may be obtained on the basis of a distance between the light-emitting pixels located at four corners and each of the light-emitting pixels (or each of the regions (A)), and $\Delta V_{th}$ of the light-emitting pixel of each of the measurement samples. More specifically, a weighted average efficiency of a value obtained by applying, to $\Delta V_{th}$ of the location of each of the measurement samples, weight which is in inverse proportion to a distance between the light-emitting pixel (or each of the regions (A)) and each of the locations of the measurement samples may be determined as $\Delta V_{th}$ of the light-emitting pixel (or each of the regions (A)).

The following describes a method of applying the voltage $V_{gs}$ applied across the gate and source of the drive transistor when an image is displayed on the display unit 6 (a voltage based on display), among methods of applying the gate-source voltage $V_{gs}$ to the drive transistor of each of the light-emitting pixels illustrated in FIG. 25. As illustrated in FIG. 25, it is possible to apply $V_{gs}$ based on actual display by the display unit 6, when a measurement sample is located within the display region (No. 1 and No. 2 of FIG. 25). However, when the measurement sample is located outside the display region (No. 3 of FIG. 25), since there is no display data for the measurement sample, it is not possible to apply $V_{gs}$ based on actual display by the display unit 6 to the measurement sample. In addition, in the case where the display region is divided into one or more regions (A), it is possible, whichever location the measurement sample is located among locations No. 1 to 3 in FIG. 25, to regard $V_{gs}$ applied to the drive transistor in the light-emitting pixel which is representative of each of the regions (A) as $V_{gs}$ applied to each drive transistor in each of the regions (A). However, in the case where the measurement sample is located within each of the light-emitting pixels (No. 1 of FIG. 25), it is possible to measure $\Delta V_{th}$ based on actual display by each of the light-emitting pixels. For that reason, it is not necessary to regard $V_{gs}$ applied to the drive transistor in the light-emitting pixel which is representative of each of the regions (A) as $V_{gs}$ applied to all of the light-emitting pixels in each of the regions (A). In addition, in the case where the measurement sample is located at the representative location inside and outside the display region (No. 2 and No. 3 of FIG. 25), it is necessary to regard $V_{gs}$ applied to the measurement sample as $V_{gs}$ applied to the drive transistor in each of the regions (A).

The following describes a method of applying a recovery voltage, among methods of applying the gate-source voltage $V_{gs}$ to the drive transistor of each of the light-emitting pixels illustrated in FIG. 25. As the method of applying a recovery voltage, a method of applying a recovery voltage which is adjusted for each light-emitting pixel and a method of applying an identical recovery voltage to all of the light-emitting pixels in the region (A) are conceivable. As illustrated in FIG. 25, it is possible, whichever location the measurement sample is located among locations No. 1 to 3 in FIG. 25, to apply the recovery voltage which is adjusted for each light-emitting pixel and to apply the identical recovery voltage to all of the light-emitting pixels in the region (A). However, in the case where the measurement sample is located at the representative location inside and outside the display region (No. 2 and No. 3 of FIG. 25), it is necessary to estimate $\Delta V_{th}$ in each of the light-emitting pixels, based on the amount of threshold voltage shift $\Delta V_{th}$ of the measurement sample, and to apply the recovery voltage obtained based on $\Delta V_{th}$ which has been estimated. For example, an average value of estimated values of $\Delta V_{th}$ of all of the light-emitting pixels in the region (A) may be obtained, and a recovery voltage obtained based on the average value may be applied.

[2-5. Advantageous Effects, Etc.]

As described above, according to the present embodiment, the threshold voltage shift of the drive transistor 102 is recovered by applying a recovery voltage across the gate and source of the drive transistor 102, in the same manner as the foregoing Embodiment 1. In addition, since the applied voltage is sufficiently applied on the basis of the threshold voltage and the application period of the drive transistor 102 according to the present embodiment, it is possible to suppress the state in which recovery of the threshold voltage shift is insufficient, and the threshold voltage shifts in the negative direction with respect to an initial value of the threshold voltage due to excessive application of the recovery voltage.

In addition, according to the present embodiment, since the amount of threshold voltage shift is read by actual measurement, it is possible to obtain the amount of threshold voltage shift more precisely. In this manner, it is possible to obtain and apply a more appropriate recovery voltage, thereby enabling further suppressing of the threshold voltage shift.

In addition, according to the present embodiment, the recovery voltage is readjusted and changed during applying of the recovery voltage, and thus it is possible to suppress inhibition of recovery of the threshold voltage caused by variation of the recovery voltage due to the effect of a leak current, for example.

In addition, according to the present embodiment, the estimated stop period of the display unit 6 is readjusted on the basis of a signal transmitted from the monitoring unit 8, and thus it is possible to reduce the possibility of display by the display unit 6 being restarted in the state in which recovery of the threshold voltage is insufficient caused by the main power switch being turned on during applying of the recovery voltage.

OTHER EMBODIMENTS

As described above, Embodiments 1, the modification of Embodiment 1, and Embodiment 2 are described as exemplifications of the technique disclosed in the present application. However, the technique according to the present disclosure is not limited to the foregoing embodiments and modifications, and can also be applied to embodiments to which a change, substitution, addition, or omission is executed as necessary.

For example, the threshold voltage may be a threshold voltage in a linear region in the foregoing embodiments and modifications. In this case, the threshold voltage is determined specifically as below.

[Definition of a Threshold Voltage in a Linear Region ($V_{gs}-V_{th}\geq V_{ds}$)]

The threshold voltage $V_{th}$ in the linear region ($V_{gs}-V_{th}\geq V_{ds}$) can be defined as a value of the gate-source voltage V corresponding to an intersection between a characteristic tangent line $I_{ds}-V_{gs}$ at a point $V_g$ at which mobility is the maximum value and a $V_{gs}$ voltage axis (x axis), which represents the transmission characteristics (characteristics between the drain-source current ($I_{ds}$) and gate-source voltage ($V_{gs}$)). Here, the mobility is obtained by assigning a gradient $dI_{ds}/dV_{gs}$ in the transmission characteristics to Expression 11 indicated below.

[Math. 11]

$$\mu = \frac{L}{WCV_{ds}}\left(\frac{dI_{ds}}{dV_{gs}}\right) \quad \text{Expression 11}$$

It should be noted that, although the mobility and $V_{th}$ are calculated using Expression 11 in the linear region ($V_{gs}-V_{th}\geq V_d$) and the aforementioned Expression 1 in the saturation region ($V_{gs}-V_{th}<V_{ds}$), it is not possible in practice to determine whether it is the linear region or the saturation region if $V_{th}$ is not known. In view of the above, once $V_{th}$ is obtained using Expression 1 and Expression 11, and then it is confirmed from the obtained $V_{th}$ that the region was the linear region or the saturation region. This makes it possible to obtain an appropriate threshold voltage by distinguishing between the two operation regions.

It should be noted that the threshold voltage may be a flat band voltage in a stack structure of the gate electrode, the gate insulating film, and the semiconductor, of a transistor.

It should be noted that the threshold voltage may be a minimum value of a curve $I_{ds}-V_{gs}$.

More specifically, the threshold voltage may be the value $V_{gs}$ of which the value of Expression 12 is 0 in the transmission characteristics ($I_{ds}-V_{gs}$ characteristics) of a transistor.

[Math. 12]

$$\frac{d\log(I_{ds})}{dV_{gs}} \quad \text{Expression 12}$$

In addition, the threshold voltage may be the value $V_{gs}$ corresponding to a current value of $1/2^n$ (n is a positive integer) of the peak current of the current $I_{ds}$, and the peak current may be a current value at the time of full white display.

In addition, although a configuration in which an n-type transistor is used as the drive transistor 102 in each of the above-described embodiments, the same advantageous effects as those of each of the above-described embodiments are produced by a display device having a configuration in which a p-type transistor is used as the drive transistor 102 and the polarity of each of the power lines is inverted.

In addition, although A is a constant in the above-described Expression 3, A may be a function of a temperature for expressing temperature dependence of the amount of deterioration. For example, A may be expressed by Expression 13 indicated below where $A_0$ is a constant, $E_a$ is an activation energy of the threshold voltage shift.

[Math. 13]

$$A = A_0\exp\left(-\frac{E_a}{kT}\right) \quad \text{Expression 13}$$

In addition, a function of measuring temperature T may be added to the display device, to calculate the amount of deterioration and the amount of recovery of the threshold voltage shift accurately according to change over time of measured temperatures.

In addition, although the duration (stop period) during which the display unit 6 is maintained in the stopped state is estimated and the application period during which the recovery voltage is applied is obtained on the basis of the estimated stop period according to each of the above-described embodiments, the application period may be fixed to a predetermined time period which is sufficient for recovery of the threshold voltage. In this case, only the recovery voltage is adjusted according to the amount of the threshold voltage shift. In contrast, the recovery voltage may be fixed and only the application period may be adjusted according to the amount of the threshold voltage shift.

In addition, the materials of the semiconductor layer of the drive transistor and the switching transistor used in the light-emitting pixel 100 of the present disclosure are not specifically limited. For example, an oxide semiconductor material such as IGZO (In—Ga—Zn—O) may be employed. Since there is little leak current in a transistor including a semiconductor layer made of an oxide semiconductor such as IGZO, it is possible to continue to apply the recovery voltage and the balance voltage for longer amount of time. In addition, in the case where transistors each including a semiconductor layer in which the threshold voltage is positive are used as the first switching transistor 111 and the third switching transistor 113, it is also possible to suppress a leak current from the gate of the drive transistor in the first switching transistor 111 and the third switching transistor 113.

In addition, although an organic EL element is used as a light-emitting element according to each of the above-described embodiments, any light-emitting element may be used as long as the light-emitting element has intensity of light emission that changes according to a current.

The display device such as an organic EL display device described above may be used as a flat panel display, and is applicable to all kinds of electronics having display devices, such as television sets, personal computers, and mobile phones.

INDUSTRIAL APPLICABILITY

The present disclosure is applicable to a display device and a method of driving the display device, and specifically to a display device such as a television set.

The invention claimed is:

1. A display device, comprising:
a display in which a plurality of light-emitting pixels are disposed in rows and columns; and
a control circuit which controls the display, wherein
each of the plurality of light-emitting pixels includes:
a light emitter; and
a drive transistor which supplies the light emitter with a current that causes the light emitter to emit light,
wherein the control circuit, when a display operation by the display is stopped, calculates an amount of shift of a threshold voltage of the drive transistor, and determines on a basis of the amount of shift, at least one of
a recovery voltage which reduces the amount of shift by being applied across a gate and source of the drive transistor while the display operation by the display is stopped, and
an application period during which the recovery voltage is applied,
wherein calculation of the amount of shift is performed during a stopped state of the display operation of the display, the stopped state of the display operation of the display occurring prior to starting the display operation of the display, and
wherein the display operation of the display is determined to be stopped by a presence or absence of a signal indicating an off operation of a main power switch of the display device which is provided to the control circuit from outside the control circuit.

2. The display device according to claim 1, wherein
the control circuit calculates the amount of shift on a basis of history of a voltage applied across the gate and source of the drive transistor.

3. The display device according to claim 1, wherein
the control circuit measures the amount of shift.

4. The display device according to claim 1, wherein
the control circuit changes the recovery voltage while the display operation by the display is stopped.

5. The display device according to claim 1, wherein
the control circuit, when the display operation by the display is stopped, estimates a stop period during which the display operation is maintained in the stopped state, and determines the application period on a basis of the estimated stop period.

6. The display device according to claim 5, wherein
the control circuit determines the recovery voltage on a basis of the application period and the amount of shift.

7. The display device according to claim 1, wherein
the control circuit applies a predetermined voltage across the gate and source of the drive transistor to suppress variation in the threshold voltage after the application period elapses.

8. The display device according to claim 1, wherein
the control circuit calculates the recovery voltage for each of the plurality of light-emitting pixels, and applies the recovery voltage to a corresponding one of the plurality of light-emitting pixels.

9. The display device according to claim 1, further comprising
a monitoring circuit configured to detect a person in proximity to the display, wherein
the application period is changed while the display operation by the display is stopped when the monitoring circuit detects a person.

10. The display device according to claim 1, wherein
the recovery voltage is applied prior to the starting of the display operation of the display.

11. The display device according to claim 1, wherein
the recovery voltage is applied during the stopped state of the display operation of the display.

12. A method for driving a display device including a control circuit and a display in which a plurality of light-emitting pixels are disposed in rows and columns,
each of the plurality of light-emitting pixels including
a light emitter, and a drive transistor which supplies the light emitter with a current that causes the light emitter to emit light,
the method for driving the display device comprising:
when a display operation by the display is stopped, calculating an amount of shift of a threshold voltage of the drive transistor; and
determining on a basis of the amount of shift, at least one of
a recovery voltage which reduces the amount of shift by being applied across a gate and source of the drive transistor while the display operation by the display is stopped, and
an application period during which the recovery voltage is applied,
wherein calculation of the amount of shift is performed during a stopped state of the display operation of the display, the stopped state of the display operation of the display occurring prior to starting the display operation of the display, and wherein the display operation of the display is determined to be stopped by a presence or absence of a signal indicating an off operation of a main power switch of the display device which is provided to the control circuit from outside the control circuit.

* * * * *